US008685604B2

(12) United States Patent
Moriya et al.

(10) Patent No.: US 8,685,604 B2
(45) Date of Patent: Apr. 1, 2014

(54) TONER, DEVELOPER, AND IMAGE FORMING APPARATUS

(75) Inventors: Yoshihiro Moriya, Shizuoka (JP); Masahide Yamada, Shizuoka (JP); Taichi Nemoto, Shizuoka (JP); Yukiko Nakajima, Kanagawa (JP); Yoshitaka Yamauchi, Shizuoka (JP); Daiki Yamashita, Kanagawa (JP); Keiji Makabe, Shizuoka (JP); Akiyoshi Sabu, Shizuoka (JP); Suzuka Amemori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/609,627

(22) Filed: Sep. 11, 2012

(65) Prior Publication Data

US 2013/0065172 A1 Mar. 14, 2013

(30) Foreign Application Priority Data

Sep. 13, 2011 (JP) ..... 2011-199274
Nov. 25, 2011 (JP) ..... 2011-257091
Jun. 19, 2012 (JP) ..... 2012-137750

(51) Int. Cl.
*G03G 9/087* (2006.01)
*G03G 9/08* (2006.01)

(52) U.S. Cl.
CPC ..... *G03G 9/08788* (2013.01); *G03G 9/0825* (2013.01); *G03G 9/08755* (2013.01); *G03G 9/08797* (2013.01)
USPC ..... 430/109.4; 399/222

(58) Field of Classification Search
CPC ..... G03G 9/0825; G03G 9/08755; G03G 9/08788; G03G 9/08797
USPC ..... 430/109.4; 399/222
See application file for complete search history.

(56) References Cited

U.S. PATENT DOCUMENTS

| | | | |
|---|---|---|---|
| 2008/0227002 | A1 | 9/2008 | Moriya et al. |
| 2009/0003885 | A1 | 1/2009 | Sabu et al. |
| 2010/0104965 | A1 | 4/2010 | Inoue et al. |
| 2010/0216068 | A1 | 8/2010 | Kotsugai et al. |
| 2011/0065036 | A1 | 3/2011 | Inoue et al. |
| 2011/0281213 | A1 | 11/2011 | Sakashita et al. |

FOREIGN PATENT DOCUMENTS

| | | | |
|---|---|---|---|
| EP | 1 107 069 | A1 | 6/2001 |
| JP | 59-096123 | | 6/1984 |
| JP | 7-033861 | | 2/1995 |
| JP | 7-120975 | | 5/1995 |
| JP | 10-301328 | | 11/1998 |
| JP | 2001-166537 | | 6/2001 |
| JP | 2004-310018 | | 11/2004 |
| JP | 2006-071906 | | 3/2006 |
| JP | 2006-189816 | | 7/2006 |
| JP | 2008-262179 | | 10/2008 |
| JP | 2009-162957 | | 7/2009 |
| JP | 2010-224517 | | 10/2010 |
| WO | WO 2009/122687 | A1 | 10/2009 |

OTHER PUBLICATIONS

Office Action issued Dec. 30, 2013, in Chinese Patent Application No. 201210334432, filed Sep. 11, 2012.

*Primary Examiner* — Peter Vajda
(74) *Attorney, Agent, or Firm* — Oblon, Spivak, McClelland, Maier & Neustadt, L.L.P.

(57) ABSTRACT

A toner including a colorant and a first binder resin is provided. The first binder resin has first and second glass transition points at a temperature Tg1 of −20 to 20° C. and a temperature Tg2 of 35 to 65° C., respectively, measured by a differential scanning calorimeter at a heating rate of 5° C./min. A ratio h1/h2 of a baseline displacement h1 observed in the first glass transition point to a baseline displacement h2 observed in the second glass transition point is less than 1.0. The first binder resin has a structure in which a first phase is dispersed in a second phase. The first and second phases consist of portions having larger and smaller phase difference values, respectively, than an intermediate value between maximum and minimum phase difference values in a binarized phase image obtained by an atomic force microscope with a tapping mode method.

13 Claims, 6 Drawing Sheets

TONER, DEVELOPER, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2011-199274, 2012-137750, and 2011-257091 filed on Sep. 13, 2011, Jun. 19, 2012, and Nov. 25, 2011, respectively, in the Japanese Patent Office, the entire disclosure of which is hereby incorporated herein by reference.

BACKGROUND

1. Technical Field

The present disclosure relates to a toner, a developer, and an image forming apparatus.

2. Description of Related Art

In an electrophotographic image forming apparatus or electrostatic recording device, an electric or magnetic latent image is developed into a toner image. For example, in electrophotography, an electrostatic latent image is formed on a photoreceptor and is developed into a toner image. The toner image is transferred onto a recording medium, such as paper, and fixed thereon by application of heat, etc.

Toner generally comprises resin particles in which colorant, charge controlling agent, etc., are dispersed, and is manufactured by various processes, such as pulverization, suspension polymerization, dissolution suspension, emulsion aggregation, phase-transfer emulsification, and elongation polymerization.

The resin particles may comprise, for example, a thermoplastic resin such as styrene-acrylic resin, polyester resin, and polyol resin. Polyester resin has superior strength and stability as well as a lower softening point while having a greater molecular weight and a higher glass transition temperature compared to styrene-acrylic resin. Therefore, polyester resin is widely used for toner especially requiring low-temperature fixability. In particular, polyester resin is widely used for toner for full-color printing.

Binder resin generally occupies 70% or more of toner composition. Most binder resins are derived from petroleum resources now being exposed to depletion. Petroleum resources cause a problem of global warming because they discharge carbon dioxide into the air when consumed. On the other hand, binder resins derived from plant resources have been proposed and used for toners. Because plant resources have incorporated carbon dioxide from the air in the process of growing, carbon dioxide discharged from plant resources is merely circulated between the air and plant resources. Thus, plant resources have the potential to solve the problems of both depletion and global warming.

Japanese Patent No. 2909873 (corresponding to Japanese Patent Application Publication No. H07-120975) describes a toner including a polylactic acid as a binder resin. Polylactic acids, derived from plant resources, are widely used and easily available. Japanese Patent Nos. 3347406 (corresponding to Japanese Patent Application Publication No. H07-33861) and Japanese Patent Application Publication No. 59-096123 describe that polylactic acid is obtainable by dehydration condensation of lactic acid monomer or ring-opening polymerization of cyclic lactide of lactic acid. Polylactic acid generally includes a larger content of ester groups than polyester resin. Ester group consists of carbon atoms only. It may be difficult to adjust toner properties with polylactic acids only.

Attempts to use polylactic acid in combination with another resin or to copolymerize polylactic acid with another resin have been made. Japanese Patent No. 3785011 (corresponding to Japanese Patent Application Publication No. 2001-166537) describes a toner including a biodegradable polylactic acid-based biodegradable resin in combination with a terpene phenol copolymer. Polylactic acids are poorly compatible with or dispersible in polyester resins or styrene-acrylic copolymers that are widely used as binder resins. This may be disadvantageous in terms of controllability of toner surface composition that has an influence on toner properties such as storage stability, chargeability, and fluidity.

It is generally difficult for toner to achieve low-temperature fixability and heat-resistant storage stability at the same time. Japanese Patent Application Publication No. 2004-310018 describes a toner including a low-molecular-weight polyester resin in combination with a high-molecular-weight polyester resin obtained by elongating a prepolymer. The toner is designed so that the low-molecular-weight polyester resin contributes to low-temperature fixability and the high-molecular-weight polyester resin contributes to hot offset resistance and heat-resistant storage stability. However, the high-molecular-weight polyester resin may inhibit fixation of the toner on paper. Mixing low-molecular-weight and high-molecular-weight resins is insufficient to obtain a toner having both low-temperature fixability and heat-resistant storage stability.

Lowering thermal properties of resin improves low-temperature fixability but degrades heat-resistant storage stability and hardness of the resin. A resin with a low hardness may cause various problems such as toner filming and deterioration of chargeability.

Japanese Patent Application Publication No. 2008-262179 describes a toner including a block copolymer resin of a polyester having a polylactic acid backbone having a specific D/L ratio with another polyester, in combination with another resin. In an electrophotographic image forming apparatus, more than half of the electric power is consumed in a fixing device. To more save energy, this toner is designed to be fixable at low temperatures.

SUMMARY

In accordance with some embodiments, a toner including a colorant and a first binder resin is provided. The first binder resin has first and second glass transition points at a temperature Tg1 of −20 to 20° C. and a temperature Tg2 of 35 to 65° C., respectively, measured by a differential scanning calorimeter at a heating rate of 5° C./min. A ratio h1/h2 of a baseline displacement h1 observed in the first glass transition point to a baseline displacement h2 observed in the second glass transition point is less than 1.0. The first binder resin has a structure in which a first phase is dispersed in a second phase. The first and second phases consist of portions having larger and smaller phase difference values, respectively, than an intermediate value between maximum and minimum phase difference values in a binarized phase image obtained by an atomic force microscope with a tapping mode method.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
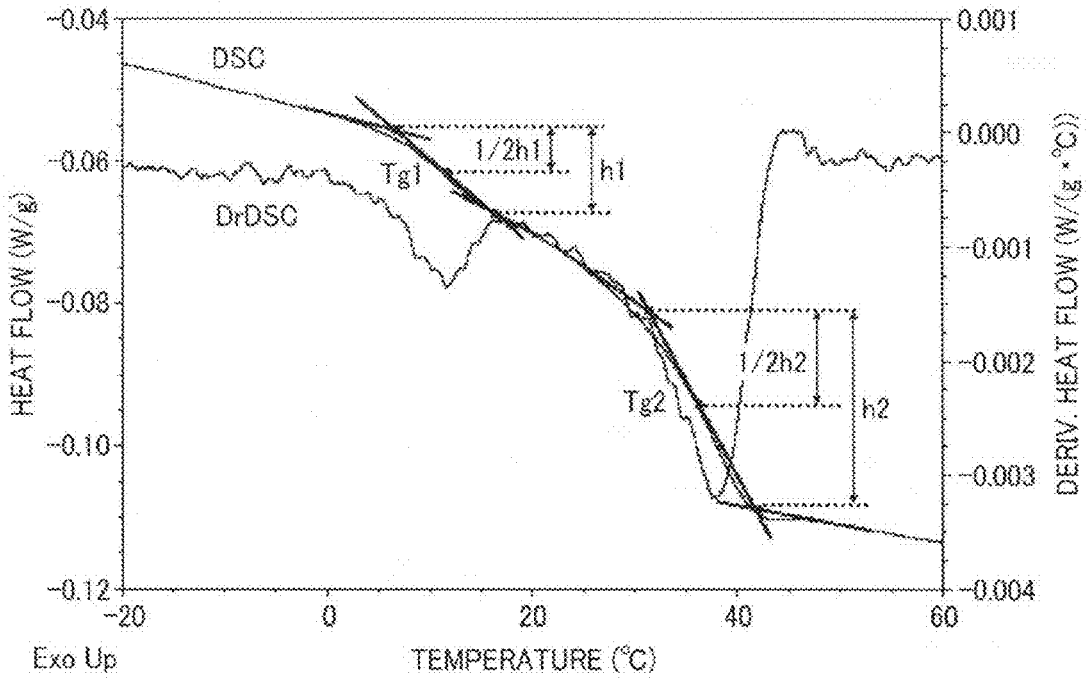
FIG. 1 is an example of an endothermic curve of the first binder resin obtained in the 2nd heating.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

A toner according to an embodiment includes a first binder resin and a colorant. The first binder resin has first and second glass transition points at a temperature Tg1 of −20 to 20° C. and a temperature Tg2 of 35 to 65° C., respectively, measured by a differential scanning calorimeter at a heating rate of 5° C./min. A ratio h1/h2 of a baseline displacement h1 observed in the first glass transition point to a baseline displacement h2 observed in the second glass transition point is less than 1.0. The first binder resin has a structure in which a first phase is dispersed in a second phase. The first and second phases consist of portions having larger and smaller phase difference values, respectively, than an intermediate value between maximum and minimum phase difference values in a binarized phase image obtained by an atomic force microscope (AFM) with a tapping mode method. In some embodiments, the average of maximum Feret diameters among domains of the first phase is less than 100 nm.

In this specification, when a boundary between the first and second phases is recognizable and the Feret diameter of the first phase is measurable in a binarized AFM phase image of the first binder resin, it is defined that the first phase is dispersed in the second phase. When the first phase is too small to be distinguishable from image noise or the Feret diameter thereof is unmeasurable in a clear manner, it is defined that the first phase is not dispersed in the second phase. When the first phase is indistinguishable from image noise and a boundary between the first and second phases is unrecognizable, the Feret diameter is unmeasurable in a clear manner.

According to another embodiment, the toner further includes a second binder resin. The second binder resin has a number average molecular weight (Mn) of 8,000 to 25,000 and a glass transition temperature (Tg3) of −5 to −15° C.

Generally, to fix a toner on a recording medium at a certain temperature, a binder resin is required to be adherable to the recording medium at that temperature. In particular, an amorphous binder resin is required to transit from a glass state to a rubber state so as to express a certain degree of fluidity and/or viscosity. Thus, to fix the toner on a recording medium at a much lower temperature, the binder resin is required to have a much lower glass transition temperature, which may undesirably cause a toner blocking problem in which toner particles are coalesced or aggregated with each other when stored. The occurrence of the toner blocking problem can be prevented by increasing the glass transition temperature but deteriorating low-temperature fixability.

According to an embodiment, low-temperature fixability and storage stability can be achieved at the same time when the first binder resin has a sea-island structure in which a low-Tg unit contributing to low-temperature fixability is finely dispersed in a high-Tg unit contributing to storage stability. Additionally, when the toner includes the second binder resin having a number average molecular weight (Mn) of 8,000 to 25,000 and a glass transition temperature (Tg3) of −5 to −15° C. in combination with the first binder resin, advantageously, the toner has an improved heat-resistant storage stability; the toner is more prevented from forming loose aggregation even when kept agitated in a developing device for an extended period of time while receiving thermal stress, and therefore production of defective image with white spots is also prevented; and the toner is more prevented from forming undesired toner film on carrier particles and degrading charging ability of the carrier particles even when the ratio of the low-Tg unit is relatively high. It is thought that the second binder resin is compatible with the low-Tg unit of the first binder resin and suppresses the low-Tg unit from exuding from the toner while not degrading low-temperature fixability of the toner.

The glass transition temperatures (Tg1, Tg2, and Tg3) of the first and second binder resins are determined from an endothermic curve obtained by a differential scanning calorimeter (DSC) such as Q2000 from TA Instruments. An aluminum simplified sealed pan is filled with 5 to 10 mg of a sample and is subjected to the following procedures.

1st heating: Heat from 3 to 220° C. at a heating rate of 5° C./min and keep at 220° C. for 1 minute.

Cooling: Quench to −60° C. without temperature control and keep at −60° C. for 1 minute.

2nd Heating: Heat from −60 to 180° C. at a heating rate of 5° C./min.

A glass transition temperature is determined from an endothermic curve obtained in the 2nd heating based on a midpoint method according to ASTM D3418/82. As to the first binder resin, a first glass transition temperature observed in a lower temperature side is defined as Tg1 and a second glass transition temperature observed in a higher temperature side is defined as Tg2. A glass transition point may be specified from an inflection point of the endothermic curve. The inflection point can be determined by drawing a DrDSC curve that is a first derivation of the endothermic curve. The amount of displacement of the baseline of the endothermic curve (hereinafter "baseline displacement") in the first and second glass transition points of the first binder resin is defined as h1 and h2, respectively. Each of the baseline displacements h1 and h2 is determined from a difference between the low-temperature side onset point and the high-temperature side endset point in the first and second glass transition points, respectively. FIG. 1 is an example of an endothermic curve of the first binder resin obtained in the 2nd heating.

The first glass transition temperature Tg1 of the first binder resin is −20 to 20° C. When Tg1 is lower than −20° C., the toner blocking problem easily occurs. When Tg1 is higher than 20° C., the difference in thermal property between the inner low-Tg unit and the outer high-Tg unit is so small that the toner cannot express sufficient low-temperature fixability. The second glass transition temperature Tg2 of the first binder resin is 35 to 65° C. When Tg2 is lower than 35° C., the high-Tg unit cannot sufficiently protect the low-Tg unit that has excellent low-temperature fixability and the toner blocking problem easily occurs. When Tg2 is higher than 65° C., the high-Tg unit prevents the inner low-Tg unit from exuding from the toner when the toner is fixed on a recording medium. The ratio h1/h2 of the baseline displacement h1 observed in the first glass transition point to the baseline displacement h2 observed in the second glass transition point is less than 1.0. In the above-described structure in which the low-Tg unit is dispersed in the high-Tg unit, Tg1 and Tg2 do not necessarily correlate with the glass transition temperatures of the backbones A and B (to be described in detail later) because the resin may take a partially-dissolved or micro phase-separated structure. The glass transition temperatures Tg1 and Tg2 may be observed between the glass transition temperatures of the backbones B and A. For the same reason, the baseline displacement ratio h1/h2 does not necessarily correlate with the weight ratio of raw materials of the first binder resin. The baseline displacement ratio h1/h2 substantially correlates with the ratio between the low-Tg unit and the high-Tg unit in the first binder resin as a final product. The baseline displacement ratio h1/h2 is less than 1.0. When h1/h2 exceeds 1.0, the ratio of the low-Tg unit is so large that the toner blocking problem occurs, the toner forms undesired film on carrier particles, and/or the reversed phase-separated structure in which the high-Tg unit is dispersed in the low-Tg unit is undesirably formed.

The first binder resin has a structure in which a unit having a glass transition temperature Tg1 contributing to low-temperature fixability is finely dispersed in a unit having a glass transition temperature Tg2 contributing to storage stability. Such a dispersion state is determined from a phase image obtained by an atomic force microscope (AFM) with a method called tapping mode. Details of the tapping mode of AFM are described in a technical document "Surface Science letter, 290, 668 (1993)". The phase image is obtained by vibrating a cantilever on a surface of a sample as described in technical documents "Polymer, 35, 5778 (1994)" and "Macromolecules, 28, 6773 (1995)". Depending on viscoelastic property of the measured surface of a sample, a phase difference is generated between a driver that is driving the cantilever and the actual vibration. The phase image is obtained by mapping these phase differences. A phase difference is large in a soft portion. A phase difference is small in a hard portion.

In the first binder resin, the unit having a lower Tg is observed as a portion with a large phase difference, i.e., a soft portion, and the unit having a higher Tg is observed as a portion with a small phase difference, i.e., a hard portion. The hard portion with a small phase difference forms the second phase that constitutes the outer phase and the soft portion with a large phase difference forms the first phase that constitutes the inner phase.

To obtain a phase image with AFM, a block of each sample (i.e., resin) is cut into an ultrathin section with an ultra microtome ULTRACUT (from Leica) under the following conditions. The ultrathin section is subjected to an observation with AFM.

Cutting thickness: 60 nm
Cutting speed: 0.4 mm/sec
Cutting instrument: Diamond knife (Ultra Sonic 35°)

As an AFM instrument, MFP-3D equipped with a cantilever OMCL-AC240TS-C3 (from Asylum Technology Co., Ltd.) can be used under the following conditions.

Target amplitude: 0.5 V
Target percent: −5%
Amplitude set point: 315 mV
Scan rate: 1 Hz
Scan points: 256×256
Scan angle: 0°

The average of the maximum Feret diameters among domains of the first phase (i.e., the soft and low-Tg unit) is determined from a binarized image of the phase image obtained by the tapping mode of AFM. The binarization is based on an intermediate value between the maximum and minimum phase difference values in the phase image. In the phase image obtained by the tapping mode of AFM, portions with smaller phase difference are represented by darker areas and portions with larger phase differences are represented by brighter areas. This phase image is binarized with the intermediate value between the maximum and minimum phase difference values. The binarized image has a size of 300 nm×300 nm. Among ten randomly-obtained binarized images, the first phase domains having the 1st to 30th largest maximum Feret diameter are chosen and their diameters are averaged. Ultrafine domains which are indistinguishable from image noise are removed from the calculation of the average maximum Feret diameter. More specifically, the first phase domains which have an area 1/100 or less the first phase domain having the 1st largest maximum Feret diameter are excluded from the calculation of the average maximum Feret diameter. The maximum Feret diameter is defined as the maximum distance between a pair of parallel tangent lines of a phase domain.

In some embodiments, the average of the maximum Feret diameters is less than 100 nm and not less than 20 nm. In some embodiments, the average of the maximum Feret diameters is from 30 to 70 nm. When the average of the maximum Feret diameters is 100 nm or more, the toner blocking problem may occur. When the average of the maximum Feret diameters is less than 20 nm, low-temperature fixability may deteriorate.

Figure 7:
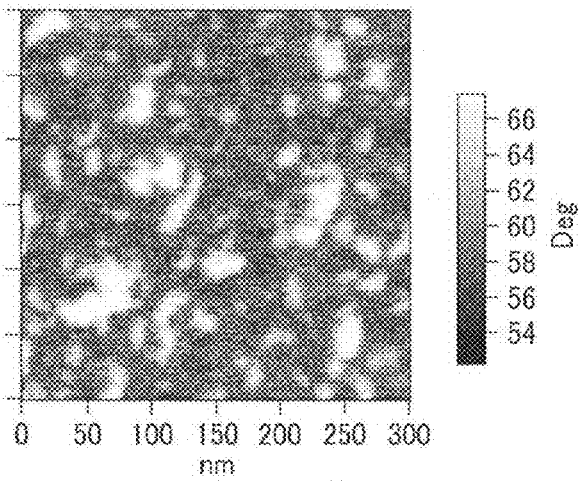
FIG. 7 is a phase image of a first binder resin according to an embodiment obtained by the tapping mode of AFM.
Figure 8:
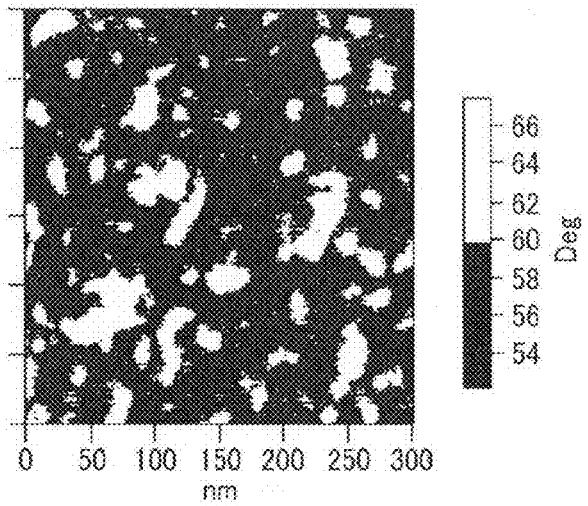
FIG. 8 is a binarized image of the phase image of FIG. 7.

FIG. 7 is a phase image of a first binder resin according to an embodiment (i.e., the resin 1 prepared in Examples). FIG. 8 is a binarized image of the phase image of FIG. 7. In FIG. 8, the bright areas represent the first phase with larger phase differences and the dark areas represent the second phase with small phase differences.

According to an embodiment, low-temperature fixability and storage stability can be achieved at the same time when the first binder resin has a sea-island structure in which a low-Tg unit with a large phase difference contributing to low-temperature fixability is finely dispersed in a high-Tg unit with a small phase difference contributing to storage stability. According to an embodiment, the first binder resin is a block copolymer of a polyester backbone A with another backbone B. The polyester backbone A has a repeating unit obtained from a dehydration condensation of a hydroxycarboxylic acid. The backbone B has no repeating unit obtained from a dehydration condensation of a hydroxycarboxylic acid. Such a block copolymer is advantageous for dispersing fine and clear domains of the low-Tg unit with large phase differences.

In some embodiments, the backbone B having no repeating unit obtained from a dehydration condensation of a hydroxycarboxylic acid has a glass transition temperature of 20° C. or less. In such embodiments, the first binder resin has a structure in which an inner phase consisting primarily of the backbone B is finely dispersed in an outer phase consisting primarily of the backbone A.

Figure 2:
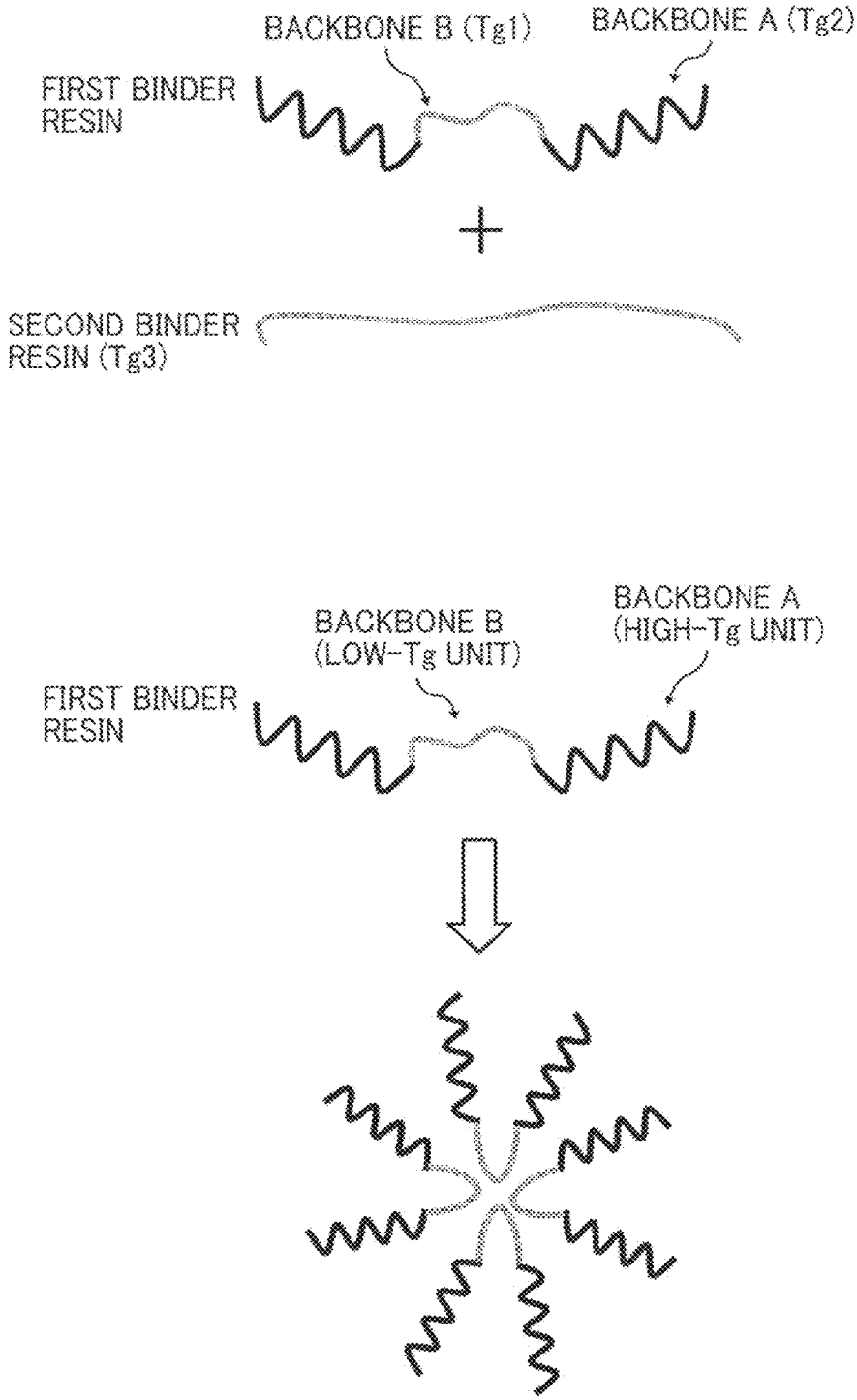
FIG. 2 is a schematic view of the first and second binder resins according to an embodiment.

FIG. 2 is a schematic view of the first and second binder resins according to an embodiment.

The polyester backbone A having a repeating unit obtained from a dehydration condensation of a hydroxycarboxylic acid has a configuration in which a single hydroxycarboxylic acid is polymerized or multiple hydroxycarboxylic acids are copolymerized. The polyester backbone A can be obtained from a hydrolysis condensation of a hydroxycarboxylic acid or a ring-opening polymerization of a cyclic ester of the hydroxycarboxylic acid, for example. In some embodiments, the polyester backbone A is obtained from a ring-opening polymerization of cyclic esters of hydroxycarboxylic acids. In such embodiments, molecular weight of the resulting polyhydroxycarboxylic acid backbone can be increased. In one or more embodiments, the polyhydroxycarboxylic acid backbone is obtained from an aliphatic hydroxycarboxylic acid in view of transparency and thermal property. In some embodiments, the polyhydroxycarboxylic acid backbone is obtained from a hydroxycarboxylic acid having 2 to 6 carbon atoms, such as lactic acid, glycolic acid, 3-hydroxybutyric acid, or 4-hydroxybutyric acid. In some embodiments, lactic acid is used in view of transparency and compatibility with resins.

When cyclic esters of hydroxycarboxylic acids are used, the resulting polyhydroxycarboxylic acid backbone has a configuration in which the hydroxycarboxylic acids are polymerized. For example, the polyhydroxycarboxylic acid backbone obtained from lactic acid lactide has a configuration in which lactic acid is polymerized.

When a mixture of L-monomer and D-monomer is used, a racemic resin can be obtained. For example, a mixture of L-lactide and D-lactide can be used as a raw material. Additionally, the polyhydroxycarboxylic acid backbone can be obtained from a ring-opening polymerization of mesolactide. Mesolactide can be used in combination with L-lactide or D-lactide.

In some embodiments, the unit obtained from a dehydration condensation of a hydroxycarboxylic acid in the first binder resin has an optical purity X (% by mol), represented by the following formula, of 80% by mol or less or 60% by mol or less.

$$X(\%\text{ by mole})=|X(L\text{-form})-X(D\text{-form})|$$

wherein X(L-form) and X(D-form) represent ratios (% by mole) of L-form and D-form hydroxycarboxylic acids, respectively.

The optical purity X can be measured as follows. First, mix an analyte (e.g., a resin or toner having a polyester backbone) with a mixture solvent of pure water, 1N sodium hydroxide, and isopropyl alcohol and agitate the mixture at 70° C. to cause hydrolysis. Next, filter the mixture to remove solid contents and add sulfuric acid to neutralize the filtrate. Thus, an aqueous solution containing L-form and/or D-form monomers (e.g., L-form and/or D-form lactic acids), which are decomposition products of the analyte (e.g., the polyester resin), is obtained. Subject the aqueous solution to a measurement with a high-speed liquid chromatography (HPLC) equipped with chiral ligand exchangeable columns SUMICHIRAL OA-5000 (from Sumika Analysis Chemical Service, Ltd.). Determine peak areas S(L) and S(D) corresponding to L-form monomer (e.g., L-lactic acid) and D-form monomer (e.g., D-lactic acid), respectively, from the resulting chromatogram. The optical purity X is calculated from the peak areas as follows.

$$X(L\text{-form})(\%)=100\times S(L)/(S(L)+S(D))$$

$$X(D\text{-form})(\%)=100\times S(D)/(S(L)+S(D))$$

$$\text{Optical purity } X(\%\text{ by mol})=|X(L\text{-form})-X(D\text{-form})|$$

L-form and D-form monomers are optical isomers. Optical isomers are equivalent in physical and chemical properties as well as polymerization reactivity, except for optical properties. The ratio of monomers is equivalent to that in the resulting polymer. When the optical purity is 80% by mol or less, solvent solubility and transparency of the resin improve.

X(D-from) and X(L-form) are respectively equivalent to the ratios of D-form and L-form monomers used for forming the polyhydroxycarboxylic acid backbone. The optical purity X (% by mol) of the polyhydroxycarboxylic acid backbone can be controlled by the use of racemic mixture of L-form and D-form monomers.

In some embodiments, the polyester backbone A having a repeating unit obtained from a dehydration condensation of a hydroxycarboxylic acid is a polylactic acid backbone. A polylactic acid is a polymer in which lactic acid is bonded with ester bonds. Polylactic acids are recently receiving attentions as environment-friendly biodegradable plastics. Because an enzyme for cutting ester bonds (i.e., esterase) is widely distributed in nature, polylactic acids are gradually decomposed into lactic acids and finally decomposed into carbon dioxide and water.

A polylactic acid resin can be obtained by, for example, preparing a lactic acid by fermenting starch such as corn, and then directly subjecting the lactic acid to a dehydration condensation; or forming a cyclic dimer lactide from the lactic acid and then subjecting the cyclic dimer lactide to a ring-opening polymerization in the presence of a catalyst. In the ring-opening polymerization, the molecular weight of the resulting resin can be controlled by varying the amount of a reaction initiator and the reaction can be terminated within a short time period, which is advantageous in terms of manufacturability.

The reaction initiator may be, for example, an alcohol regardless of the number of functional groups which does not volatilize even when dried at about 100° C. under a reduced pressure of 20 mmHg or less or even when heated at a high temperature of about 200° C. in the polymerization.

As described above, in some embodiments, the backbone B having no repeating unit obtained from a dehydration condensation of a hydroxycarboxylic acid has a glass transition temperature of 20° C. or less. In such embodiments, the first binder resin has a Tg1 of 20° C. or less and has a structure in which an inner phase consisting primarily of the backbone B is finely dispersed in an outer phase consisting primarily of the backbone A. In some embodiments, the backbone B having no repeating unit obtained from a dehydration condensation of a hydroxycarboxylic acid is obtained from a compound having at least two hydroxyl groups. Such a compound functions as a reaction initiator for a ring-opening polymerization of lactide for preparing the first binder resin. When the backbone B is formed from such a compound having at least two hydroxyl groups, the first binder resin has an improved affinity for colorants. When the compound has the high-Tg unit derived from the backbone A on its both ends, it is likely that the low-Tg unit derived from the backbone B is dispersed internally.

The backbone B may be, for example, a backbone of a polyether, a polycarbonate, a polyester, a vinyl resin having a hydroxyl group, or a silicone resin having a terminal hydroxyl group. In some embodiments, the backbone B is a polyester backbone in view of affinity for colorant.

The polyester backbone as the backbone B can be obtained from a ring-opening addition polymerization of a polyester obtained from at least one polyol having the following formula (1) and at least one polycarboxylic acid having the following formula (2).

$$A\text{-}(OH)m \quad (1)$$

In the formula (1), A represents an alkyl group, an alkylene group, a substituted or unsubstituted aromatic group, or a heterocyclic aromatic group, having 1 to 20 carbon atoms, and m represents an integer of 2 to 4.

$$B\text{—}(COOH)n \quad (2)$$

In the formula (2), B represents an alkyl group, an alkylene group, a substituted or unsubstituted aromatic group, or a heterocyclic aromatic group, having 1 to 20 carbon atoms, and n represents an integer of 2 to 4.

Specific examples of the polyol having the formula (1) include, but are not limited to, ethylene glycol, diethylene glycol, triethylene glycol, 1,2-propylene glycol, 1,3-propanediol, 1,4-butanediol, neopentyl glycol, 1,4-butenediol, 1,5-pentanediol, 3-methyl-1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6,-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adduct of bisphenol A, propylene oxide adduct of bisphenol A, hydrogenated bisphenol A, ethylene oxide adduct of hydrogenated bisphenol A, and propylene oxide adduct of hydrogenated bisphenol A. Two or more of these materials can be used in combination.

Specific examples of the polycarboxylic acid having the formula (2) include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, enpol trimmer acid, cyclohexanedicarboxylic acid, cyclohexenedicarboxylic acid, butanetetracarboxylic acid, diphenylsulfone tetracarboxylic acid, and ethylene glycol bis(trimellitic acid). Two or more of these materials can be used in combination.

In some embodiments, the polyester backbone as the backbone B is obtained from acid constituents including 1.5% by mol or more of a polycarboxylic acid having three or more valences. Specific examples of the polycarboxylic acid having three or more valences include, but are not limited to, trimellitic acid. By introduction of the polycarboxylic acid having three or more valences, the first binder resin has a branched or cross-linked structure. Thus, the molecular chain of the first binder resin is substantially shortened. With such a branched structure, the domain size of the backbone B that is forming the inner phase can be reduced. Therefore, the average of the maximum Feret diameters among domains of the first phase with a large phase difference observed in an AFM phase image can be also reduced. When the content of the polycarboxylic acid having 3 or more valences is less than 1.5% by mol, the degree of branching is so small that the domain size of the backbone B is unnecessarily increased and therefore the average of the maximum Feret diameters among domains of the first phase with a large phase difference is also unnecessarily increased. As a result, heat-resistant storage stability of the toner may deteriorate. In some embodiments, the content of the polycarboxylic acid having 3 or more valences is 3% by mol or less. When the content of the polycarboxylic acid having 3 or more valences exceeds 3% by mol, the branched or cross-linked structure gets so complicated that the molecular weight may be unnecessarily increased or solvent solubility may deteriorate.

In some embodiments, the weight ratio of the backbone B in the first binder resin is 25 to 50% or 25 to 40%. When the weight ratio of the backbone B is less than 25%, the low-Tg unit may not sufficiently contribute to low-temperature fixability. When the weight ratio of the backbone B exceeds 50%, the toner blocking problem may occur or the toner may form undesired film on carrier particles.

In some embodiments, the backbone B has a number average molecular weight (Mn) of 3,000 to 5,000 or 3,000 to 4,000. When Mn of the backbone B is less than 3,000, domains of the low-Tg unit may be too fine to contribute to low-temperature fixability. When Mn of the backbone B exceeds 5,000, the low-Tg unit is exposed at a surface of the toner. As a result, the toner blocking problem may occur or the toner may form undesired film on carrier particles.

In some embodiments, the first binder resin has a number average molecular weight (Mn) of 20,000 or less, or 8,000 to 15,000. When Mn of the first binder resin exceeds 20,000, fixability and solvent solubility of the toner may be poor.

In some embodiments, the content of the first binder resin in the toner is 60% by weight or more or 80% by weight or more. When the content of the first binder resin is less than 60% by weight, low-temperature fixability and toner blocking resistance of the toner may be poor.

In accordance with some embodiments, the toner includes the first binder resin in combination with the second binder resin. The second binder resin has a number average molecular weight (Mn) of 8,000 to 25,000 and a glass transition temperature (Tg3) of −5 to −15° C. In some embodiments, the second binder resin has a number average molecular weight (Mn) of 10,000 to 20,000 and a glass transition temperature (Tg3) of 5 to 10° C. It is thought that the second binder resin is compatible with the low-Tg unit of the first binder resin and suppresses the low-Tg unit from exuding from the toner. As a result, toner blocking resistance and filming resistance of the toner are improved while low-temperature fixability of the toner is not degraded. When the number average molecular weight (Mn) is less than 8,000, the second binder resin does not sufficiently suppress the low-Tg unit from exuding from the toner. As a result, toner blocking resistance and filming resistance of the toner may be poor. When the number average molecular weight (Mn) exceeds 25,000, the second binder resin prevents the toner from adhering to paper. As a result, low-temperature fixability of the toner may be poor. Additionally, it may be difficult to form such a second binder resin into toner particles because solvent solubility is poor. When the glass transition temperature (Tg3) is less than 5° C., toner blocking resistance and filming resistance of the toner may be poor. When the glass transition temperature (Tg3) exceeds 10° C., low-temperature fixability of the toner may be poor.

In some embodiments, the second binder resin is a polyester having no repeating unit obtained from a dehydration condensation of a hydroxycarboxylic acid, in view of solubility with the low-Tg unit (i.e., backbone B) of the first binder resin.

The polyester having no repeating unit obtained from a dehydration condensation of a hydroxycarboxylic acid, as the second binder resin, can be obtained by elongating a polyester resin having a functional group with a compound having an active hydrogen group. The functional group of the polyester resin may be, for example, a functional group reactive with an active hydrogen, such as an isocyanate group.

The polyester resin having an isocyanate group may be obtained by reacting a polyisocyanate (PIC) with a polyester having an active hydrogen group.

The active hydrogen group may be, for example, a hydroxyl group (e.g., an alcoholic hydroxyl group, a phenolic hydroxyl group), an amino group, a carboxyl group, or a mercapto group. In some embodiments, an alcoholic hydroxyl group is employed.

Specific examples of the polyisocyanate (PIC) include, but are not limited to, aliphatic polyisocyanates (e.g., tetramethylene diisocyanate, hexamethylene diisocyanate, 2,6-diisocyanatomethyl caproate); alicyclic polyisocyanates (e.g., isophorone diisocyanate, cyclohexylmethane diisocyanate); aromatic diisocyanates (e.g., tolylene diisocyanate, diphenylmethane diisocyanate); aromatic aliphatic diisocyanates (e.g., α,α,α',α'-tetramethylxylylene diisocyanate); isocyanurates; the above polyisocyanates in which the isocyanate group is blocked with a phenol derivative, an oxime, or a caprolactam; and combinations thereof. In some embodiments, IPDI is used in view of reactivity.

The compound having an active hydrogen group that serves as an elongating agent may be an amine. A reaction between an amine and a polyester resin having an isocyanate group produces an urea-modified polyester (UMPE).

The amine may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

In some embodiments, the weight ratio of the second binder resin to the first binder resin is 40/60 to 10/90. When the weight ratio of the second binder resin exceeds 40/60, the low-Tg unit (i.e., backbone B) of the first binder resin is prevented from exuding the toner. As a result, low-temperature fixability may be poor. When the weight ratio of the second binder resin is less than 10/90, toner blocking resistance and filming resistance of the toner may be poor.

In some embodiments, either the first binder resin or the second binder resin includes a polyester having no repeating unit obtained from a dehydration condensation of a hydroxycarboxylic acid which has a branched structure. As to the first binder resin, the molecular chain is substantially shortened owing to the branched structure and therefore the backbone B can be dispersed into small domains.

As to the second binder resin, the molecular chain is substantially shortened owing to the branched structure and therefore compatibility with the low-Tg unit (i.e., the backbone B) of the first binder resin is improved.

In some embodiments, either the first binder resin or the second binder resin includes a polyester having no repeating unit obtained from a dehydration condensation of a hydroxycarboxylic acid, and the polyester is obtained from acid constituents including 1.5% by mol or more of a polycarboxylic acid having three or more valences. Specific examples of the polycarboxylic acid having three or more valences include, but are not limited to, trimellitic acid. By introduction of the polycarboxylic acid having three or more valences such as trimellitic acid, the resin is given a branched or cross-linked structure. When the content of the polycarboxylic acid having 3 or more valences is less than 1.5% by mol, the degree of branching is so small that the domain size of the backbone B is unnecessarily increased. As a result, heat-resistant storage stability of the toner may deteriorate. In some embodiments, the content of the polycarboxylic acid having 3 or more valences is 3% by mol or less. When the content of the polycarboxylic acid having 3 or more valences exceeds 3% by mol, the branched or cross-linked structure gets so complicated that the molecular weight may be unnecessarily increased or solvent solubility may deteriorate.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these materials can be used in combination.

Usable colorants are not limited in its color. The toner may include either a black, cyan, magenta, or yellow colorant or a combination thereof.

Specific examples of usable black colorants include, but are not limited to, carbon blacks such as furnace black, lamp black (C.I. Pigment Black 7), acetylene black, and channel black; metals such as copper, iron (C.I. Pigment Black 11), and titanium oxide; and organic pigments such as aniline black (C.I. Pigment Black 1).

Specific examples of usable magenta colorants include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; and C.I. Vat Red 1, 2, 10, 13, 15, 23, 29, and 35.

Specific examples of usable cyan colorants include, but are not limited to, C.I. Pigment Blue 2, 3, 15, 15:1, 15:2, 15:3, 15:4, 15:6, 16, 17, and 60; C.I. Vat Blue 6; C.I. Acid Blue 45; copper phthalocyanine pigments having a phthalocyanine skeleton substituted with 1 to 5 phthalimidemethyl groups; and Green 7 and Green 35.

Specific examples of usable yellow colorants include, but are not limited to, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, 2, and 20; and Orange 36.

In some embodiments, the content of the colorants in the toner is 1 to 15% by weight or 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

The colorant can be combined with a resin to be used as a master batch. Specific examples of usable resins include, but are not limited to, polyester, polymers of styrene or styrene derivatives, styrene-based copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Additionally, polyester resins having a polyhydroxycarboxylic acid backbone are also usable. Such resins are derived from plants. Two or more of these materials can be used in combination.

Specific examples of usable polymers of styrene or styrene derivatives include, but are not limited to, polystyrene, poly-p-chlorostyrene, and polyvinyl toluene. Specific examples of the styrene-based copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading a resin and a colorant while applying a high shearing force. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

In some embodiments, the toner includes a release agent having a melting point of 50 to 120° C. In a case in which such a low-melting-point release agent is dispersed in the binder resin, the toner can be effectively release from a fixing roller when the toner is fixed on a recording medium by being pressed by the fixing roller. Thus, the toner does not cause hot offset problem even when the fixing roller is not applied with any release agent such as oil.

Specific examples of such release agents include, but are not limited to, waxes. Specific examples of usable waxes include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax). Specific examples of usable waxes further include, but are not limited to, synthetic hydrocarbon waxes (e.g., Fischer-Tropsch wax, polyethylene wax) and synthetic waxes (e.g., ester wax, ketone wax, ether wax). Further, the following materials are also usable as the release agent: fatty acid amides such as 1,2-hydroxystearic acid amide, stearic acid amide, phthalic anhydride imide, and chlorinated hydrocarbon; homopolymers and copolymers of polyacrylates (e.g., n-stearyl polymethacrylate, n-lauryl polymethacrylate), which are low-molecular-weight crystalline polymers; and crystalline polymers having a long alkyl side chain. Two or more of these materials can be used in combination.

In some embodiments, the release agent has a melting point of 50 to 120° C. or 60 to 90° C. When the melting point is less than 50° C., heat-resistant storage stability of the toner may be poor. When the melting point is greater than 120° C., cold offset resistance of the toner may be poor.

In some embodiments, the release agent has a melt-viscosity of 5 to 1,000 cps or 10 to 100 cps, at a temperature 20° C. higher than the melting point. When the melt-viscosity is less than 5 cps, releasability of the toner may be poor. When the melt-viscosity is greater than 1,000 cps, hot offset resistance and low-temperature fixability of the toner may be poor.

In some embodiments, the content of the release agent in the toner is 40% by weight or less or 3 to 30% by weight. When the content of the release agent is greater than 40% by weight, fluidity of the toner may be poor.

Specific examples of usable waxes further include, but are not limited to, free-fatty-acid-free carnauba wax, polyethylene wax, montan wax, oxidized rice wax, and combinations thereof.

In some embodiments, a microcrystalline carnauba wax having an acid value of 5 or less, which can be dispersed in the binder resin with a dispersion diameter of 1 μm or less, is used. In some embodiments, a microcrystalline montan wax, obtained by purifying a mineral, having an acid value of 5 to 14 is used. In some embodiments, a oxidized rice wax, obtained by oxidizing a rice bran wax with air, having an acid value of 10 to 30 is used. These waxes can be finely dispersed in the resin according to an embodiment, which can provide a toner having a good combination of hot offset resistance, transferability, and durability. Two or more kinds of the above waxes can be used in combination.

Specific materials usable as the release agent further include, but are not limited to, solid silicone wax, higher fatty acid higher alcohol, montan ester wax, polyethylene wax, polypropylene wax, and combinations thereof.

In one or more embodiments, the release agent has a glass transition temperature (Tg) of 70 to 90° C. When Tg is less than 70° C., heat-resistant storage stability of the toner may be poor. When Tg is greater than 90° C., cold-offset resistance of the toner may be poor, i.e., the toner may not be releasable at low temperatures and undesirably winds around a fixing member.

In one or more embodiments, the content of the release agent in the toner is 1 to 20% by weight or 3 to 10% by weight. When the content of the release agent is less than 1% by weight, offset resistance of the toner may be poor. When the content of the release agent is greater than 20% by weight, transferability and durability of the toner may be poor.

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Two or more of these materials can be used in combination.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

In some embodiments, the content of the charge controlling agent is 0.1 to 10 parts by weight or 0.2 to 5 parts by weight, based on 100 parts by weight of the binder resin. When the content of the charge controlling agent is less than 0.1 parts by weight, it is difficult to control charge of the toner. When the content of charge controlling agent is greater than 10 parts by weight, the toner may be excessively charged and excessively electrostatically attracted to a developing roller, resulting in poor fluidity of the developer and low image density.

Specific examples of usable charge controlling agents further include, but are not limited to, nigrosine dyes, azine dyes having an alkyl group having 2 to 16 carbon atoms described in Examined Japanese Application Publication No. 42-1627; basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000)) and lake pigments thereof; quaternary ammonium salts (e.g., C.I. Solvent Black 8 (C.I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385; sulfonated copper phthalocyanine pigments; organic boron salts; fluorine-containing quaternary ammonium salts; and calixarene compounds.

When the toner includes a colorant other than black, a whitish charge controlling agent, such as a metal salt of a salicylic acid derivative, may be used so that the colorant can express its color.

In some embodiments, the content of the charge controlling agent is 0.01 to 2 parts by weight or 0.02 to 1 part by weight based on 100 parts of the binder resin. When the content of the charge controlling agent is 0.01 parts by weight or more, good charge controllability is provided. When the content of charge controlling agent is 2 parts by weight or less, the toner is not excessively charged nor excessively electrostatically attracted to a developing roller, preventing deterioration of fluidity and image density while keeping good charge controllability.

The toner may further include fine particles of an inorganic material on the surface thereof to improve fluidity, developability, and chargeability.

Specific examples of usable inorganic materials include, but are not limited to, silica, alumina, titanium oxide, barium titanate, magnesium titanate, calcium titanate, strontium titanate, zinc oxide, tin oxide, quartz sand, clay, mica, sandlime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of these materials can be used in combination.

In some embodiments, the inorganic fine particles have a primary particle diameter of 5 nm to 2 μm or 5 nm to 500 nm.

In some embodiments, the content of the inorganic fine particles in the toner is 0.01 to 5.0% by weight or 0.01 to 2.0% by weight.

In some embodiments, the inorganic material (e.g., silica, titanium oxide) is surface-treated with a fluidity improving agent, such as a silane coupling agent, a silylation agent, a silane coupling agent having a fluorinated alkyl group, an organic titanate coupling agent, an aluminum coupling agent, a silicone oil, and a modified silicone oil, to improve hydrophobicity. Such a hydrophobized inorganic material does not degrade fluidity and chargeability even in high-humidity conditions.

The toner may further include a cleanability improving agent so as to be easily removable from a photoreceptor or a primary transfer medium when remaining thereon after image transfer. Specific examples of usable cleanability improving agents include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, the fine particles of polymers have a narrow size distribution and a volume average particle diameter of 0.01 to 1 μm.

Specific examples of usable magnetic materials include, but are not limited to, iron powder, magnetite, and ferrite. In some embodiments, a magnetic material having a whitish color is used.

Shape controlling agents are adapted to control the shape of toner. Specific materials usable as the shape controlling agent include, but are not limited to, layered inorganic minerals in which at least a part of interlayer ions are modified with an organic ion (hereinafter "modified layered inorganic minerals"). Specific examples of such modified layered inorganic minerals include, but are not limited to, organic-cation-modified smectite-based materials. Metal anions can be introduced to a layered inorganic mineral by replacing a part of divalent metals with trivalent metals. In this case, at least a part of the introduced metal anions may be modified with an organic anion so as not to increase hydrophilicity of the layered inorganic mineral.

Specific materials usable as the organic cation modifying agent include, but are not limited to, quaternary alkyl ammonium salts, phosphonium salts, and imidazolium salts. In one or more embodiments, quaternary alkyl ammonium salts are used. Specific examples of the quaternary alkyl ammonium salts include, but are not limited to, trimethyl stearyl ammonium, dimethyl stearyl benzyl ammonium, and oleylbis(2-hydroxyethyl)methyl ammonium.

Specific materials usable as the organic anion modifying agent include, but are not limited to, sulfates, sulfonates, carboxylates, and phosphates having a branched, non-branched, or cyclic alkyl (C1-C44), alkenyl (C1-C22), alkoxy (C8-C32), hydroxyalkyl (C2-C22), ethylene oxide, or propylene oxide. In one or more embodiments, carboxylic acids having an ethylene oxide skeleton are used.

The modified layered inorganic mineral has proper hydrophobicity due to the modification by the organic ion. A toner components liquid including such a modified layered inorganic mineral expresses non-Newtonian viscosity, which is capable of controlling or varying the resulting toner shape.

Specific examples of the modified layered inorganic minerals include, but are not limited to, montmorillonite, bentonite, hectorite, attapulgite, sepiolite, and mixtures thereof. In some embodiments, an organic-modified montmorillonite or bentonite is used. They can easily control viscosity of the toner components liquid at a small amount without adversely affecting other toner properties.

In some embodiments, the content of the modified layered inorganic mineral in the toner is 0.05 to 10% by weight or 0.05 to 5% by weight.

Specific examples of commercially available organic-cation-modified layered inorganic minerals include, but are not limited to, quaternium 18 bentonite such as BENTONE® 3, BENTONE® 38, and BENTONE® 38V (from Rheox), TIXOGEL VP (from United Catalyst), and CLAYTONE® 34, CLAYTONE® 40, and CLAYTONE® XL (from Southern Clay Products); stearalkonium bentonite such as BENTONE® 27 (from Rheox), TIXOGEL LG (from United Catalyst), and CLAYTONE® AF and CLAYTONE® APA (from Southern Clay Products); and quaternium 18/benzalkonium bentonite such as CLAYTONE® HT and CLAYTONE® PS (from Southern Clay Products). In some embodiments, CLAYTONE® AF or CLAYTONE® APA is used.

Specific examples of commercially available organic-anion-modified layered inorganic minerals include, but are not limited to, HITENOL 330 (from Dai-ichi Kogyo Seiyaku Co., Ltd.) obtainable by modifying DHT-4A (from Kyowa Chemical Industry Co., Ltd.) with an organic anion represented by the following formula (3):

$$R_1(OR_2)_nOSO_8M \quad (3)$$

wherein $R_1$ represents an alkyl group having 13 carbon atoms, $R_2$ represents an alkylene group having 2 to 6 carbon atoms, n represents an integer of 2 to 10, and M represents a monovalent metal element.

The toner according to an embodiment may be manufactured by various processes such as kneading-pulverization, emulsion aggregation, dissolution suspension, dissolution emulsification, suspension granulation, suspension polymerization, and ester elongation. In a case in which the second binder resin is obtained by elongating a polyester resin having a functional group with a compound having an active hydrogen group, ester elongation process is preferred.

A) Kneading Pulverization Process:

Kneading-pulverization process includes the first premixing step, the second melt-kneading step, the third pulverization step, and the fourth classification step.

In the first premixing step, toner components such as a binder resin, a colorant, and a hydrophobized particle, are mixed under dry condition. The toner components may further include a release agent and a charge controlling agent, for example.

Usable mixers include, but are not limited to, Henschel-type mixers such as FM MIXER (from Mitsui Mining & Smelting Co., Ltd.), SUPER MIXER (from KAWATA MFG Co., Ltd.), and MECHANOMILL (from Okada Seiko Co., Ltd.); ONG MILL (from Hosokawa Micron Corporation); HYBRIDIZATION SYSTEM (from Nara Machinery); and COSMO SYSTEM (from Kawasaki Heavy Industries, Ltd.).

In the second melt-kneading step, the mixture prepared in the first premixing step is melt-kneaded. The mixture is melt-kneaded at a temperature not less than the softening point and less than the thermal decomposition temperature of the binder resin so that toner components other than the binder resin are dispersed in the melted or softened binder resin.

The melt-kneading may be performed using a kneader such as a double-axis extruder, a two-roll mill, a three-roll mill, or a labo plastomill. More specifically, single-axis or double-axis extruders such as TEM-100B (from Toshiba Machine Co., Ltd.) and PCM-65/87 and PCM-30 (both from Ikegai Co., Ltd.); and open roll kneaders such as MOS320-1800 and KNEADEX (both from Nippon Coke and Engineering Co., Ltd.) are usable. The mixture may be kneaded using two or more of these kneaders.

In the third pulverization step, the melt-kneaded mixture prepared in the second melt-kneading step is solidified by cooling, and the solidified melt-kneaded mixture is further pulverized. First, the solidified melt-kneaded mixture is coarsely pulverized into coarse particles having a volume average particle diameter of about 100 μm to 5 mm by a hammer mill or a cutting mill. The coarse particles are further pulverized into fine particles having a volume average particle diameter of about 15 μm or less.

The fine pulverization may be performed by a jet-type pulverizer that uses supersonic jet air or an impact pulverizer that introduces samples into a space formed between a rotor rotating at a high speed and a stator. The solidified melt-kneaded mixture may be directly pulverized into fine particles by the jet-type pulverizer or impact pulverizer without going through coarse particles.

In the fourth classification step, the particles prepared in the third pulverization step are classified by size so that excessively-pulverized particles and oversized particles are removed. Such excessively-pulverized particles and oversized particles can be recycled for another toner manufacture. The classification may be performed by a swivel wind power classifier (rotary wind power classifier) that removes excessively-pulverized particles and oversized particles by centrifugal force and wind power. The classification condition is set so that toner particles having a volume average particle diameter of 3 to 15 μm are obtained.

B) Emulsification Aggregation Process:

Emulsification aggregation process includes the first aggregation step, the second adhesion step, and the third fusion step. In advance, binder resin particles are prepared by a typical emulsion polymerization, for example.

In the first aggregation step, binder resin particles obtained by emulsion polymerization are dispersed in a solvent with an ionic surfactant. Other toner components, such as colorant, are dispersed in a solvent with another ionic surfactant having the opposite polarity. These dispersions are mixed to cause hetero aggregation. Thus, aggregated particles are formed.

In the second adhesion step, resin particles are optionally added and adhered to the surfaces of the aggregated particles so that a covering layer is formed on the aggregated particles. This process may make the resulting toner have a core-shell structure.

In the third fusion step, the aggregated particles having gone through the aggregation and the optional adhesion steps are fused with each other at or above the highest glass transition point or melting point of the binder resins. The fused particles are then washed and dried to obtain toner particles.

As described above, the second adhesion step is optional. In a case in which the adhesion step is employed, in the first aggregation step, initial amounts of ionic surfactants in respective dispersions are made unbalanced. The ionic surfactants are then ionically neutralized with an inorganic metal salt (e.g., calcium nitrate) or an inorganic metal salt polymer (e.g., polyaluminum chloride) to form and stabilize aggregated particles (i.e., core particles) at or below the glass transition point or melting point of the binder resin.

In the adhesion step, additional binder resin particles are added and adhered to the surface of the core particles. The additional binder resin particles have been treated with a specific amount of a dispersant having a specific polarity so that the unbalance among the dispersions is compensated. Optionally, the core particles adhering the additional binder resin particles are slightly heated to a temperature equal to or below the glass transition point of the binder resin or additional binder resin and stabilized at a higher temperature, before being fused with each other by being heated to a temperature equal to or above the glass transition point of the additional binder resin. The adhesion step can be repeated for several times.

C) Dissolution Suspension Process:

Dissolution suspension process includes the steps of dissolving toner components such as a binder resin, a colorant, and a release agent in an organic solvent (e.g., ethyl acetate); and dispersing the resulting solution in an aqueous medium with an inorganic fine particle (e.g., calcium phosphate) or an organic dispersant (e.g., polyvinyl alcohol, sodium polyacrylate) upon application of mechanical shearing force by a homogenizer such as TK HOMOMIXER.

The resulting dispersion is added to 1M hydrochloric acid aqueous solution so that the dispersants are dissolved and removed, and is further filtered so that solid components and liquid components are separated. Finally, the solvents remaining in the resulting particles are removed. Thus, toner particles are obtained.

D) Dissolution Emulsification Process:

Dissolution emulsification process includes the steps of dissolving a binder resin in an organic solvent (e.g., ethyl acetate); emulsifying the resulting solution by mechanical shearing force from a homogenizer such as TK HOMOMIXER and surface activating force of ionic surfactants (e.g., sodium alkylbenzene sulfonate) to form binder resin particles; and removing residual solvent by reduced-pressure distillation, to obtain a dispersion of the binder resin particles. Succeeding steps are the same as the emulsion aggregation method described above.

E) Suspension Granulation Process:

Suspension granulation process includes the steps of preparing a polymer solution including a prepolymer having a weight average molecular weight (Mw) of 3,000 to 15,000 measured by GPC (gel permeation chromatography); adding toner components such as a colorant, a monomer, a polymerization initiator, and a release agent to the polymer solution; suspending the resulting solution upon application of mechanical shearing force in the presence of an inorganic or organic dispersant; and applying thermal energy to the resulting suspension upon application of agitation shearing force to prepare polymer particles.

When the prepolymer has a weight average molecular weight (Mw) of 3,000 to 15,000, the above solutions have a proper viscosity and the resulting toner has a proper fixing property. Additionally, the weight average molecular weight (Mw) of the binder resin included in the resultant toner is controllable without chain transfer agent.

F) Suspension Polymerization Process:

Suspension polymerization process includes the steps of agitating a polymerizable mixture including a monomer, a polymerization initiator, a colorant, a release agent, etc. in an aqueous medium containing a suspension stabilizer, to prepare polymer particles. Alternatively, suspension polymerization process includes the steps of agitating a polymerizable mixture including a monomer, a polymerization initiator, a colorant, a release agent, and a cationic polymer, in an aqueous medium containing an anionic dispersant, to prepare polymer particles. The resulting toner has a configuration such that the release agent is encapsulated in the suspending particle. Thus, this toner has improved fixability and offset resistance.

G) Ester Elongation Process:

Ester elongation process includes the steps of emulsifying a toner components liquid including at least a binder resin and forming toner particles. More specifically, the ester elongation process may include the following steps.

(1) Preparation of Toner Components Liquid:

In the first step, a toner components liquid is prepared by dissolving or dispersing toner components such as a colorant and a binder resin in an organic solvent.

Other than the binder resin and the colorant, the toner components may further include, for example, a release agent, a charge controlling agent, etc. The organic solvent is removed during or after the process of forming toner particles.

The organic solvent may be a volatile solvent having a boiling point less than 150° C., which is easily removable. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. In some embodiments, an ester solvent is used. In some embodiments, ethyl acetate is used. Two or more of these solvents can be used in combination.

In some embodiments, the used amount of the organic solvent is 40 to 300 parts by weight, 60 to 140 parts by weight, or 80 to 120 parts by weight, base on 100 parts by weight of the toner components.

(2) Preparation of Aqueous Medium:

In the second step, an aqueous medium is prepared from an aqueous solvent, such as water, a water-miscible solvent, and mixtures thereof.

Specific examples of usable water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone. Two or more of these materials can be used in combination.

The aqueous medium is prepared by dispersing resin particles in an aqueous solvent. The added amount of the resin particles may be, for example, 0.5 to 10% by weight.

The resin particles may be comprised of a resin capable of forming an aqueous dispersion thereof. Specific examples of such resins include, but are not limited to, thermoplastic and thermosetting resins such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination.

In some embodiments, a vinyl resin, a polyurethane resin, an epoxy resin, a polyester resin, or a combination thereof is used because they are easy to form an aqueous dispersion of fine spherical particles thereof.

Specific examples of usable vinyl resins include, but are not limited to, homopolymers and copolymers of vinyl monomers such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The resin particles can be also obtained from monomers having two or more unsaturated groups. Specific examples of such monomers having two or more unsaturated groups include, but are not limited to, a sodium salt of sulfuric ester of ethylene oxide adduct of methacrylic acid (e.g., ELEMINOL RS-30 from Sanyo Chemical Industries, Ltd.), divinylbenzene, and 1,6-hexanediol diacrylate.

The resin particles may be obtained in the form of aqueous dispersion as follows, for example.

(i) An aqueous dispersion of a vinyl resin is obtainable by directly subjecting raw materials including a vinyl monomer to a suspension polymerization, an emulsion polymerization, a seed polymerization, or a dispersion polymerization.

(ii) An aqueous dispersion of a polyaddition or polycondensation resin (e.g., polyester resin, polyurethane resin, epoxy resin) is obtainable by dispersing a precursor (e.g., monomer, oligomer) of the resin or a solution thereof in an aqueous medium in the presence of a dispersant, and curing the precursor by application of heat or addition of a curing agent.

(iii) An aqueous dispersion of a polyaddition or polycondensation resin (e.g., polyester resin, polyurethane resin, epoxy resin) is obtainable by dissolving an emulsifier in a precursor (e.g., monomer, oligomer) of the resin or a solution (preferably in a liquid state, or which may be liquefied by application of heat) thereof, and further adding water thereto to cause phase-transfer emulsification.

(iv) An aqueous dispersion of a resin produced by a polymerization reaction (e.g., addition polymerization, ring-opening polymerization, polyaddition, addition condensation, polycondensation) is obtainable by pulverizing the resin into particles by a mechanical rotary pulverizer or a jet pulverizer, classifying the particles by size to collect desired-size particles, and dispersing the collected particles in an aqueous medium in the presence of a dispersant.

(v) An aqueous dispersion of a resin produced by a polymerization reaction (e.g., addition polymerization, ring-opening polymerization, polyaddition, addition condensation, polycondensation) is obtainable by dissolving the resin in a solvent, spraying the resulting resin solution to form resin particles, and dispersing the resin particles in an aqueous medium in the presence of a dispersant.

(vi) An aqueous dispersion of a resin produced by a polymerization reaction (e.g., addition polymerization, ring-opening polymerization, polyaddition, addition condensation, polycondensation) is obtainable by dissolving the resin in a solvent and further adding a poor solvent to the resulting resin solution, or dissolving the resin in a solvent by application of heat and cooling the resulting resin solution, to precipitate resin particles, removing the solvents to isolate the resin particles, and dispersing the resin particles in an aqueous medium in the presence of a dispersant.

(vii) An aqueous dispersion of a resin produced by a polymerization reaction (e.g., addition polymerization, ring-opening polymerization, polyaddition, addition condensation, polycondensation) is obtainable by dissolving the resin in a solvent, dispersing the resulting resin solution in an aqueous medium in the presence of a dispersant, and removing the solvent by application of heat and/or reduction of pressure.

(viii) An aqueous dispersion of a resin produced by a polymerization reaction (e.g., addition polymerization, ring-opening polymerization, polyaddition, addition condensation, polycondensation) is obtainable by dissolving the resin in a solvent, dissolving an emulsifier in the resulting resin solution, and adding water thereto to cause phase-transfer emulsification.

The aqueous medium may include a dispersant for the purpose of stabilizing liquid droplets to be formed when the toner components liquid is emulsified in the aqueous medium, to obtain toner particles with a desired shape and a narrow particle size distribution. The dispersant may be, for example, a surfactant, a poorly-water-soluble inorganic compound, or a polymeric protection colloid. Two or more of the materials can be used in combination. In one or more embodiments, a surfactant is used.

Usable surfactants include anionic surfactants, cationic surfactants, nonionic surfactants, and ampholytic surfactants.

Specific examples of usable anionic surfactants include, but are not limited to, alkylbenzene sulfonate, α-olefin sulfonate, phosphate, and anionic surfactants having a fluoroalkyl group. Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl (C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl)perfluorooctane sulfonamide, perfluoroalkyl(C6-C10)sulfonamide propyl trimethyl ammonium salts, perfluoroalkyl(C6-C10)-N-ethyl sulfonyl glycine salts, and monoperfluoroalkyl(C6-C16)ethyl phosphates. Specific examples of commercially available such anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3 M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of usable cationic surfactants include, but are not limited to, amine salt type surfactants, quaternary ammonium salt type surfactants, and cationic surfactants having a fluoroalkyl group. Specific examples of the amine salt type surfactants include, but are not limited to, alkylamine salts, amino alcohol fatty acid derivatives, polyamine fatty acid derivatives, and imidazoline. Specific examples of the quaternary ammonium salt type surfactants include, but are not limited to, alkyl trimethyl ammonium salt, dialkyl dimethyl ammonium salt, alkyl dimethyl benzyl ammonium salt, pyridinium salt, alkyl isoquinolinium salt, and benzethonium chloride. Specific examples of the cationic surfactants having a fluoroalkyl group include, but are not limited to, aliphatic primary, secondary, and tertiary amine acids having a fluoroalkyl group, aliphatic quaternary ammonium salts such as perfluoroalkyl(C6-C10)sulfonamide propyl trimethyl ammonium salts, benzalkonium salts, benzethonium chlorides, pyridinium salts, and imidazolinium salts are also usable as cationic surfactants.

Specific examples of commercially available such cationic surfactants having a fluoroalkyl group include, but are not limited to, SURFLON® S-121 (from AGC Seimi Chemical Co., Ltd.); FLUORAD FC-135 (from Sumitomo 3 M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Specific examples of usable nonionic surfactants include, but are not limited to, fatty acid amide derivatives and polyol derivatives.

Specific examples of usable ampholytic surfactants include, but are not limited to, alanine, dodecyl di(aminoethyl)glycine, di(octylaminoethyl)glycine, and N-alkyl-N,N-dimethyl ammonium betaine.

Specific examples of usable poorly-water-soluble inorganic compounds include, but are not limited to, tricalcium phosphate, calcium carbonate, titanium oxide, colloidal silica, and hydroxyapatite.

Specific examples of usable polymeric protection colloids include, but are not limited to, homopolymers and copolymers obtained from monomers, such as acid monomers, acrylate and methacrylate monomers having hydroxyl group, vinyl alcohol monomers, vinyl ether monomers, vinyl carboxylate monomers, amide monomers and methylol compounds thereof, chloride monomers, and/or monomers containing nitrogen or a nitrogen-containing heterocyclic ring; and polyoxyethylenes and celluloses.

Specific examples of the acid monomers include, but are not limited to, acrylic acid, methacrylic acid, α-cyanoacrylic acid, α-cyanomethacrylic acid, itaconic acid, crotonic acid, fumaric acid, maleic acid, and maleic anhydride.

Specific examples of the acrylate and methacrylate monomers having hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide.

Specific examples of the vinyl ether monomers include, but are not limited to, vinyl methyl ether, vinyl ethyl ether, and vinyl propyl ether. Specific examples of the vinyl carboxylate monomers include, but are not limited to, vinyl acetate, vinyl propionate, and vinyl butyrate.

Specific examples of the amide monomers include, but are not limited to, acrylamide, methacrylamide, and diacetone acrylamide.

Specific examples of the chloride monomers include, but are not limited to, acrylic acid chloride and methacrylic acid chloride.

Specific examples of the monomers containing nitrogen or a nitrogen-containing heterocyclic ring include, but are not limited to, vinyl pyridine, vinyl pyrrolidone, vinyl imidazole, and ethylene imine.

Specific examples of the polyoxyethylene resins include, but are not limited to, polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester.

Specific examples of the celluloses include, but are not limited to, methyl cellulose, hydroxyethyl cellulose, and hydroxypropyl cellulose.

A dispersion stabilizer is usable when preparing the aqueous dispersion of resin particles. Specific examples of usable dispersion stabilizers include, but are not limited to, acid-soluble or alkali-soluble compounds such as calcium phosphate.

The aqueous medium may further include a catalyst for urea or urethane reaction, such as dibutyl tin laurate or dioctyl tin laurate, when the toner components include a polyester prepolymer reactive with a compound having an active hydrogen group.

(3) Preparation of Emulsion Slurry:

In the third step, the toner components liquid is emulsified in the aqueous medium while being agitated. Specific instruments usable for the emulsification include, but are not limited to, batch emulsifiers such as HOMOGENIZER (from IKA Japan), POLYTRON® (from KINEMATICA AG), and TK AUTO HOMO MIXER® (from PRIMIX Corporation); continuous emulsifiers such as EBARA MILDER® (from Ebara Corporation), TK FILMICS® (from PRIMIX Corporation), TK PIPELINE HOMO MIXER® (from PRIMIX Corporation), colloid mill (from SHINKO PANTEC CO., LTD.), slasher, trigonal wet pulverizer (from Mitsui Miike Machinery Co., Ltd.), CAVITRON® (from Eurotec), and FINE FLOW MILL® (from Pacific Machinery & Engineering Co., Ltd.); high-pressure emulsifiers such as MICROFLUIDIZER (from Mizuho Industrial Co., Ltd.), NANOMIZER (from NANOMIZER Inc.), and APV GAULIN (SPX Corporation); film emulsifier (from REICA Co., Ltd.); vibration emulsifiers such as VIBRO MIXER (from REICA Co., Ltd.); and ultrasonic emulsifiers such as ultrasonic homogenizer (from BRANSON). In one or more embodiments, APV GAULIN, HOMOGENIZER, TK AUTO HOMO MIXER®, EBARA MILDER®, TK FILMICS®, or TK PIPELINE HOMO MIXER® is used in view of uniform particle diameter.

(4) Removal of Organic Solvents:

In the fourth step, the organic solvent is removed from the emulsion slurry.

The organic solvent can be removed from the emulsion by (1) gradually heating the emulsion to completely evaporate the organic solvent from liquid droplets or (2) spraying the emulsion into dry atmosphere to completely evaporate the organic solvent from liquid droplets. In the latter case, aqueous dispersants, if any, can also be evaporated.

(5) Washing, Drying, and Classification:

After complete removal of the organic solvent from the emulsion, mother toner particles are obtained. In the fifth step, the mother toner particles are washed, dried, and optionally classified by size. Undesired fine particles are removed by cyclone separation, decantation, or centrifugal separation, for example. Alternatively, dried mother toner particles are subject to classification. In a case in which a dispersant soluble in acids and bases (e.g., calcium phosphate) is used, the resulting mother particles may be first washed with an acid (e.g., hydrochloric acid) and then washed with water to remove the dispersant.

(6) External Addition of Inorganic Fine Particles:

In the sixth step, the dried toner particles are optionally mixed with fine particles of inorganic materials, such as silica and titanium oxide, and/or charge controlling agents, followed by application of mechanical impulsive force, so that release agent particles are prevented from releasing from the surfaces of the mother toner particles.

Mechanical impulsive force can be applied to the mother toner particles by agitating the mother toner particles with blades rotating at a high speed, or accelerating the mother toner particles in a high-speed airflow so that the toner particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

The toner is not limited in its properties, such as shape and size. In some embodiments, the toner has the following properties in terms of volume average particle diameter (Dv), number average particle diameter (Dn), penetration, low-temperature fixability, and offset resistance.

In one or more embodiments, the toner has a volume average particle diameter (Dv) of from 3 to 8 μm. When Dv is less than 3 μm, such toner particles may undesirably fuse on the surfaces of carrier particles and degrade charging ability of the carrier particles after a long-term agitation in a developing device, when used for a two-component developer. Such toner particles may also fuse on a developing roller or a toner layer regulator, when used for a one-component developer. When Dv exceeds 8 μm, such toner particles may be difficult to produce high-resolution and high-quality images. Moreover, the average particle diameter may largely vary upon consumption and supply of such toner particles used for a developer.

In some embodiments, the ratio (Dv/Dn) of the volume average particle diameter (Dv) to the number average particle diameter (Dn) is 1.00 to 1.25.

When Dv/Dn is less than 1.00, such toner particles may undesirably fuse on the surfaces of carrier particles and degrade charging ability of the carrier particles and cleanability of toner particles after a long-term agitation in a developing device, when used for a two-component developer. Such toner particles may also fuse on a developing roller or a toner layer regulator, when used for a one-component developer. When Dv/Dn exceeds 1.30, it may be difficult to produce high-resolution and high-quality images. Moreover, the average particle diameter of such toner particles in a developer may largely vary upon consumption and supply of the toner particles.

When Dv/Dn is 1.00 to 1.25, the toner has a good combination of storage stability, low-temperature fixability, hot offset resistance, and gloss property. When such a toner is used for a two-component developer, the average toner size may not vary very much although consumption and supply of toner particles are repeated. When such a toner is used for a one-component developer, the average toner size may not vary very much although consumption and supply of toner particles are repeated. Additionally, the toner may not adhere or fix to a developing roller or a toner layer regulating blade. Thus, stable developability is provided for an extended period of time.

Volume average particle diameter (Dv) and number average particle diameter (Dn) of the toner can be measured by a particle size analyzer MULTISIZER II (from Beckman Coulter, Inc.).

In some embodiments, the toner has a penetration of 15 mm or more or 25 mm or more when measured by a penetration test based on JIS K2235-1991. When the penetration is less than 15 mm, heat-resistant storage stability of the toner may be poor.

The penetration is measured based on a method according to JIS K-2235-1991 as follows. First, fill a 50-ml glass vial with a toner and leave the vial in a constant-temperature chamber at 50° C. for 20 hours. Cool the vial to room temperature and subject the toner to the penetration test. Penetration (mm) represents how deep the needle penetrates the toner in the vial. The greater the penetration, the better the heat-resistant storage stability of the toner.

Generally, it is preferable that the minimum fixable temperature is as low as possible and the maximum fixable temperature is as high as possible. In some embodiments, the toner has a minimum fixable temperature of 130° C. or less and a maximum fixable temperature of 180° C. or more.

The minimum fixable temperature is a temperature below which the residual rate of image density of a solid toner image fixed on a thick paper at that temperature falls below 70% after the solid toner image is rubbed with a pad. The maximum fixable temperature is a temperature above which hot offset does not occur in a toner image fixed on a paper at that temperature.

A developer according to an embodiment includes the above-described toner and other components such as a carrier. The developer may be either a one-component developer or a two-component developer. The two-component developer is compatible with high-speed printers, in accordance with recent improvement in information processing speed, owing to its long lifespan.

In some embodiments, the two-component developer includes the toner in an amount of 1 to 10 parts by weight based on 100 parts by weight of the carrier.

In the one-component developer according to an embodiment, the average toner size may not vary very much although consumption and supply of toner particles are repeated. Additionally, toner particles may not adhere or fix to a developing roller or a toner layer regulating blade. Thus, the one-component developer reliably provides stable developability and image quality for an extended period of time. In the two-component developer according to an embodiment, the average toner size may not vary very much although consumption and supply of toner particles are repeated. Thus, the two-component developer reliably provides stable developability for an extended period of time.

The carrier may comprise a core material and a resin layer that covers the core material.

Specific examples of usable core materials include, but are not limited to, manganese-strontium (Mn—Sr) and manganese-magnesium (Mn—Mg) materials having a magnetization of 50 to 90 emu/g. High magnetization materials such as iron powders having a magnetization of 100 emu/g or more and magnetites having a magnetization of 75 to 120 emu/g are suitable for improving image density. Additionally, low magnetization materials such as copper-zinc (Cu—Zn) materials having a magnetization of 30 to 80 emu/g are suitable for producing a high-quality image, because carriers made of such materials can weakly contact a photoreceptor. Two or more of these materials can be used in combination.

In some embodiments, the core material has a volume average particle diameter of 10 to 150 μm or 20 to 80 μm. When the volume average particle diameter is less than 10 μm, it means that the resulting carrier particles include a relatively large amount of fine particles, and therefore the magnetization per carrier particle is too low to prevent carrier particles scattering. When the volume average particle diameter is greater than 150 μm, it means that the specific surface area of the carrier particle is too small to prevent toner particles from scattering. Therefore, solid portions in full-color images may not be reliably reproduced.

In some embodiments, the core material has a weight average particle diameter (D50) of 10 to 200 μm or 40 to 100 μm. When D50 is less than 10 μm, it means that the resulting carrier particles include a relatively large amount of fine particles and therefore the magnetization per carrier particle is too low to prevent the carrier particles from scattering.

When D50 is greater than 200 μm, it means that the specific surface area of the carrier particle is too small to prevent toner particles from scattering. Therefore, solid portions in full-color images may not be reliably reproduced.

Specific examples of usable resins for the resin layer include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidene fluoride-acrylic monomer copolymer, vinylidene fluoride-vinyl fluoride copolymer, tetrafluoroethylene-vinylidene fluoride-non-fluoride monomer terpolymer, and silicone resins. Two or more of these resins can be used in combination. In one or more embodiments, a silicone resin is used in view of prevention of formation of toner film on carrier particles.

Specific examples of usable amino resins include, but are not limited to, urea-formaldehyde resin, melamine resin, benzoguanamine resin, urea resin, polyamide resin, epoxy resin. Specific examples of usable polyvinyl resins include, but are not limited to, acrylic resin, polymethyl methacrylate resin, polyacrylonitrile resin, polyvinyl acetate resin, polyvinyl alcohol resin, and polyvinyl butyral resin. Specific examples of usable polystyrene resins include, but are not limited to, polystyrene and styrene-acrylic copolymer. Specific examples of the halogenated olefin resins include, but are not limited to, polyvinyl chloride. Specific examples of the polyester resins include, but are not limited to, polyethylene terephthalate and polybutylene terephthalate.

The silicone resin may be, for example, a straight silicone resin consisting of organosiloxane bonds; or a alkyd-modified, polyester-modified, epoxy-modified, acrylic-modified, or urethane-modified silicone resin.

Specific examples of commercially available silicone resins include, but are not limited to, KR271, KR255, and KR152 (from Shin-Etsu Chemical Co., Ltd.); and SR2400, SR2406, and SR2410 (from Dow Corning Toray Co., Ltd.).

Specific examples of commercially available modified silicone resins include, but are not limited to, KR206 (alkyd-modified), KR5208 (acrylic-modified), ES1001N (epoxy-modified), and KR305 (urethane-modified) (from Shin-Etsu Chemical Co., Ltd.); and SR2115 (epoxy-modified) and SR2110 (alkyd-modified) (from Dow Corning Toray Co., Ltd.).

The silicone resin can be used alone or in combination with other components such as a cross-linkable component and a charge controlling component.

The resin layer may include a conductive powder such as metal, carbon black, titanium oxide, tin oxide, and zinc oxide. In some embodiments, the conductive powder has a volume average particle diameter of 1 μm or less. When the volume average particle diameter is greater than 1 μm, it may be difficult to control electric resistivity of the resin layer.

The resin layer can be formed by, for example, dissolving a resin (e.g., a silicone resin) in an organic solvent to prepare a coating liquid, and uniformly applying the coating liquid on the surface of the core material, followed by drying and baking. The coating method may be, for example, dip coating, spray coating, or brush coating.

Specific examples of usable organic solvents include, but are not limited to, toluene, xylene, methyl ethyl ketone, methyl isobutyl ketone, cellosolve, and butyl acetate.

The baking method may be either an external heating method or an internal heating method that uses a stationary electric furnace, a fluid electric furnace, a rotary electric furnace, a burner furnace, or microwave.

In some embodiments, the content of the resin layer in the carrier is 0.01 to 5.0% by weight. When the content of the resin layer is less than 0.01% by weight, it means that the resin layer cannot be uniformly formed on the core material. When the content of the resin layer is greater than 5.0% by weight, it means that the resin layer is so thick that each carrier particles are fused with each other.

In some embodiments, the content of the carrier in the two-component developer is 90 to 98% by weight or 93 to 97% by weight.

An image forming method according to an embodiment includes at least an electrostatic latent image forming process, a developing process, a transfer process, and a fixing process. The image forming method may optionally include other processes such as a neutralization process, a cleaning process, a recycle process, and a control process, if needed.

An image forming apparatus according to an embodiment includes at least an electrostatic latent image bearing member, an electrostatic latent image forming device, a developing device, a transfer device, and a fixing device. The image forming apparatus may optionally include other members, such as a neutralizer, a cleaner, a recycler, and a controller, if needed.

The electrostatic latent image forming process is a process which forms an electrostatic latent image on an electrostatic latent image bearing member. The electrostatic latent image bearing member (hereinafter may be referred to as "electrophotographic photoreceptor" or "photoreceptor") is not limited in material, shape, structure, and size. In some embodiments, the electrostatic latent image bearing member has a drum-like shape and is comprised of an inorganic photoconductor, such as amorphous silicone or selenium, or an organic photoconductor, such as polysilane or phthalopolymethyne. Amorphous silicone is advantageous in terms of long lifespan.

In the electrostatic latent image forming process, an electrostatic latent image forming device uniformly charges a surface of the electrostatic latent image bearing member and irradiates the charged surface with light containing image information. The electrostatic latent image forming device comprises a charger for uniformly charging a surface of the electrostatic latent image bearing member and an irradiator for irradiating the charged surface with light containing image information.

The charger is adapted to charge a surface of the electrostatic latent image bearing member by supplying a voltage thereto. The charger may be, for example, a contact charger equipped with a conductive or semiconductive roll, brush, film, or rubber blade, or a non-contact charger such as corotron and scorotron that use corona discharge.

In some embodiments, the charger is disposed in contact or non-contact with the electrostatic latent image bearing member so as to supply an AC-DC superimposed voltage to a surface of the electrostatic latent image bearing member. In some embodiments, the charger is a non-contact charging roller disposed proximal to the electrostatic latent image bearing member, adapted to supply an AC-DC superimposed voltage to a surface of the electrostatic latent image bearing member.

The irradiator is adapted to irradiate the charged surface of the electrostatic latent image bearing member with light containing image information. The irradiator may be, for example, a radiation optical type, a rod lens array type, a laser optical type, or a liquid crystal shutter optical type. The electrostatic latent image bearing member may be irradiated with light from the reverse surface (back surface) side thereof.

The developing process is a process which develops the electrostatic latent image into a toner image that is visible with the toner or developer according to an embodiment. The developing device is adapted to develop the electrostatic latent image into a toner image with the toner or developer according to an embodiment. In some embodiments, the developing device includes a developing unit adapted to store and supply the toner or developer to the electrostatic latent image with or without contacting the electrostatic latent image.

The developing device may employ either a dry developing method or a wet developing method. The developing device may be either a single-color developing device or a multicolor developing device. The developing device may be comprised of an agitator for frictionally agitating and charging the developer and a rotatable magnet roller.

In these embodiments, toner particles and carrier particles are mixed and agitated within the developing device so that the toner particles are frictionally charged. The charged toner particles and carrier particles are borne on the surface of the magnet roller forming chainlike aggregations (hereinafter "magnetic brush"). The magnet roller is disposed adjacent to the electrostatic latent image bearing member. Therefore, a part of the toner particles in the magnetic brush migrates from the surface of the magnet roller to the surface of the electrostatic latent image bearing member due to electrical attractive force. As a result, the electrostatic latent image formed on the electrostatic latent image bearing member is developed into a toner image.

The transfer process is a process that transfers the toner image onto a recording medium. In some embodiments, the toner image is primarily transferred onto an intermediate transfer medium and secondarily transferred onto the recording medium.

In some embodiments, a plurality of toner images with different colors is primarily transferred onto the intermediate transfer medium to form a composite toner image and the composite toner image is secondarily transferred onto the recording medium. The toner image may be transferred from the electrostatic latent image bearing member upon charging of the electrostatic latent image bearing member by a transfer charger.

In some embodiments, the transfer device includes a plurality of primary transfer devices each adapted to transfer a toner image onto the intermediate transfer medium to form a composite toner image, and a secondary transfer device adapted to transfer the composite toner image onto the recording medium.

The intermediate transfer medium may be, for example, a transfer belt.

In some embodiments, each transfer device (including the primary transfer device and the secondary transfer device) contains a transfer unit adapted to separate a toner image from the electrostatic latent image bearing member toward a recording medium side.

The number of transfer devices is not limited, i.e., one or more. The transfer unit may be, for example, a corona discharger, a transfer belt, a transfer roller, a pressure transfer roller, or an adhesive transfer unit. The recording medium is not limited to a specific material, and any kind of material can be used as the recording medium.

The fixing process is a process which fixes the toner image on a recording medium.

Each single-color toner image may be independently fixed on a recording medium, or alternatively, a composite toner image including a plurality of color toner images may be fixed on a recording medium at once. In some embodiments, the fixing device includes fixing members adapted to fix a toner image by application of heat and pressure. For example, the fixing device may include a combination of a heating roller and a pressing roller, or a combination of a heating roller, a pressing roller, and an endless belt. In some embodiments, the fixing device includes a heater equipped with a heating element, a film in contact with the heater, and a pressing member pressed against the heater with the film therebetween. Such a fixing device is adapted to pass a recording medium having a toner image thereon between the film and the pressing member so that the toner image is fixed on the recording medium upon application of heat and pressure. In some embodiments, the heating member is heated to a temperature of 80 to 200° C. In the fixing process, an optical fixer can be used in place of or in combination with the fixing device.

The neutralization process is a process in which the neutralizer neutralizes the electrostatic latent image bearing member by supplying a neutralization bias thereto. The neutralizer may be, for example, a neutralization lamp.

The cleaning process is a process in which the cleaner removes residual toner particles remaining on the electrostatic latent image bearing member. The cleaner may be, for example, a magnetic brush cleaner, an electrostatic brush cleaner, a magnetic roller cleaner, a blade cleaner, a brush cleaner, or a web cleaner.

The recycle process is a process in which the recycler supplies the residual toner particles collected in the cleaning process to the developing device. The recycler may be, for example, a conveyer.

The control process is a process in which the controller controls the above-described processes. The controller may be, for example, a sequencer or a computer.

Figure 3:
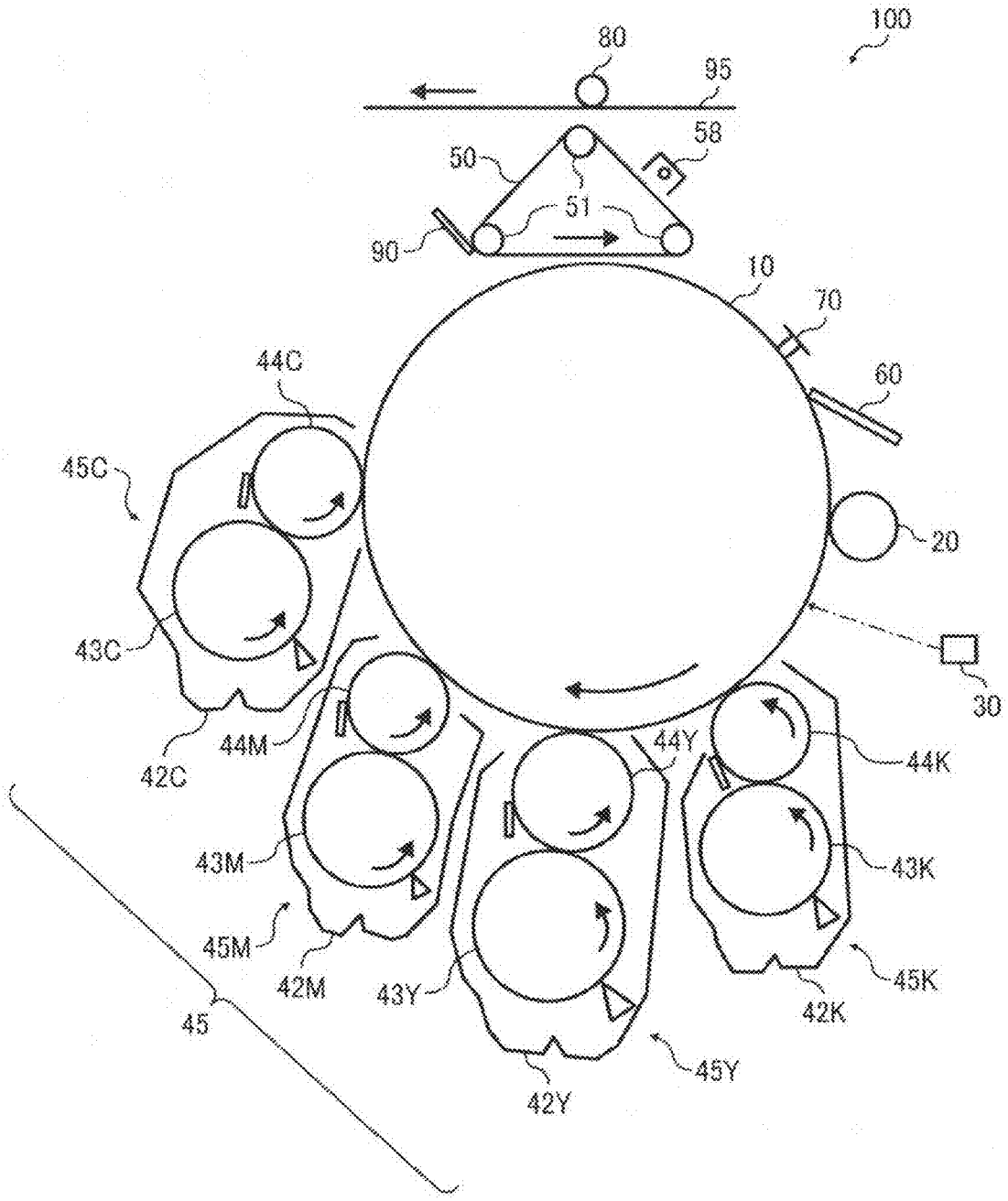
FIG. 3 is a schematic view of an image forming apparatus according to an embodiment.

FIG. 3 is a schematic view of an image forming apparatus according to an embodiment. An image forming apparatus 100 includes a photoreceptor drum 10 serving as the electrostatic latent image bearing member, a charging roller 20, an irradiator 30, a developing device 45, an intermediate transfer medium 50, a cleaning device 60, and a neutralization lamp 70.

An intermediate transfer medium 50 is a seamless belt stretched taut with three rollers 51 and is movable in a direction indicated by arrow in FIG. 3. One of the three rollers 51 is adapted to supply a primary transfer bias to the intermediate transfer medium 50. A cleaner 90 is disposed adjacent to the intermediate transfer medium 50.

A transfer roller 80 is disposed facing the intermediate transfer medium 50. The transfer roller 80 is adapted to supply a secondary transfer bias for transferring a toner image onto a recording medium 95. A corona charger 58 is disposed facing the intermediate transfer medium 50 between the contact points of the intermediate transfer medium 50 with the photoreceptor drum 10 and the recording medium 95 with respect to the direction of rotation of the intermediate transfer medium 50. The corona charger 58 is adapted to give charge to the toner image on the intermediate transfer medium 50.

The developing device 45 includes a black developing unit 45K, an yellow developing unit 45Y, a magenta developing unit 45M, and a cyan developing unit 45C. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C.

In the image forming apparatus 100, the charging roller 20 uniformly charges the photoreceptor 10. The irradiator 30 irradiates the photoreceptor 10 with light containing image information to form an electrostatic latent image thereon. The developing device 45 supplies toner to the electrostatic latent image formed on the photoreceptor 10 to form a toner image. The toner image is primarily transferred onto the intermediate transfer medium 50 by a voltage supplied from the roller 51 and is secondarily transferred onto the recording medium 95. Residual toner particles remaining on the photoreceptor 10 are removed by the cleaning device 60. The photoreceptor 10 is neutralized by the neutralization lamp 70.

Figure 4:
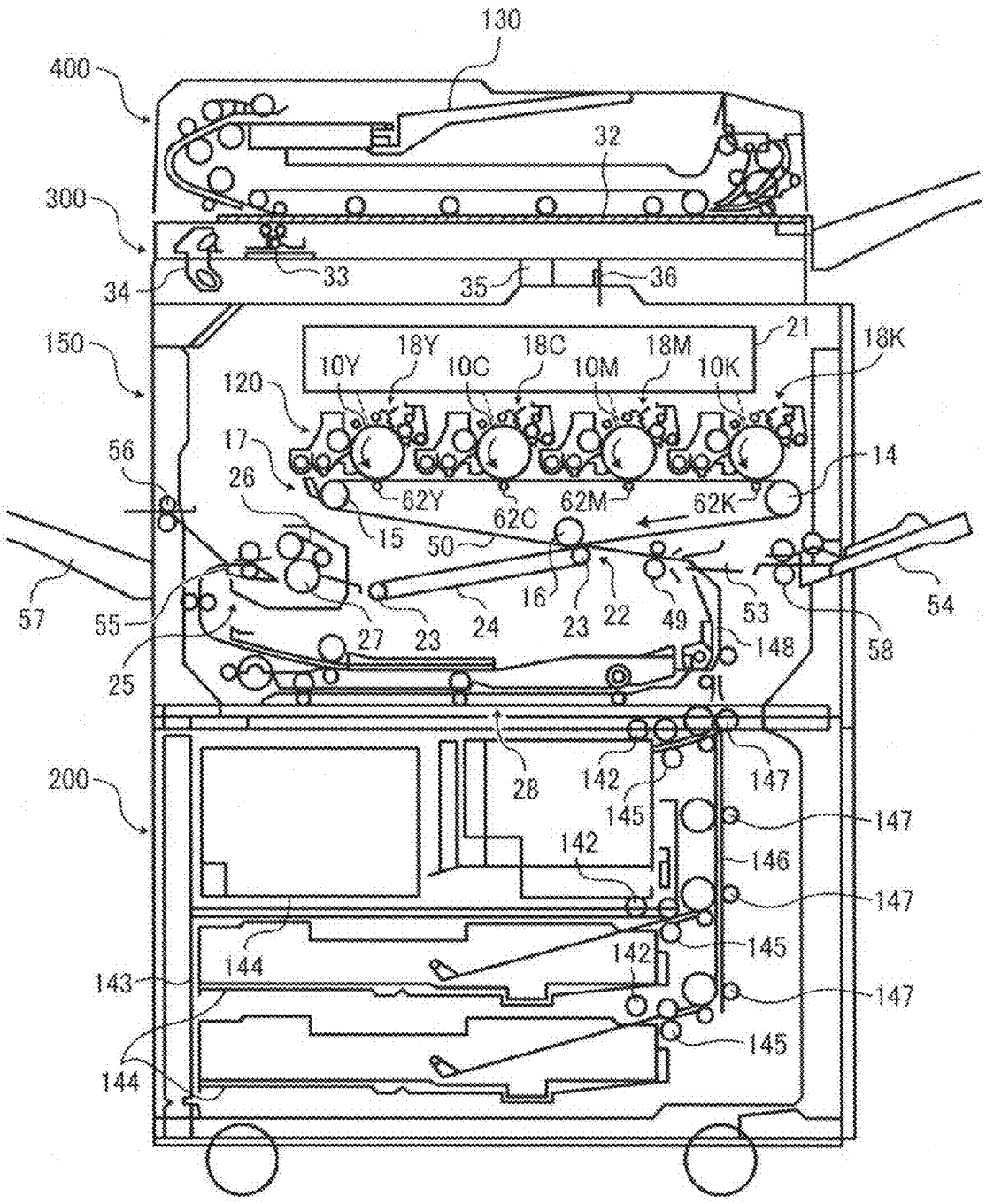
FIG. 4 is a schematic view of an image forming apparatus according to another embodiment.
Figure 5:
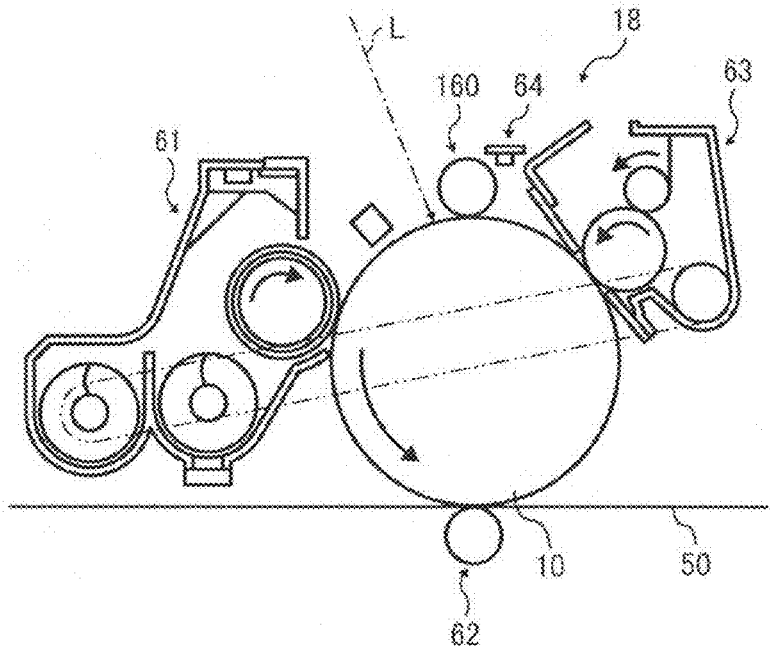
FIG. 5 is a magnified view of a part of the image forming apparatus illustrated in FIG. 4.

FIG. 4 is a schematic view of an image forming apparatus according to another embodiment. An image forming apparatus illustrated in FIG. 4 is a tandem-type full-color image forming apparatus including a main body 150, a paper feed table 200, a scanner 300, and an automatic document feeder (ADF) 400. FIG. 5 is a magnified view of a part of the image forming apparatus illustrated in FIG. 4.

A seamless-belt intermediate transfer medium 50 is disposed at the center of the main body 150. The intermediate transfer medium 50 is stretched taut with support rollers 14, 15, and 16 and is rotatable clockwise in FIG. 4. A cleaner 17 is disposed adjacent to the support roller 15. The cleaner 17 is adapted to remove residual toner particles remaining on the intermediate transfer medium 50. Four image forming units 18Y, 18C, 18M, and 18K (hereinafter collectively the "image forming units 18") adapted to form respective toner images of yellow, cyan, magenta, and cyan are disposed in tandem facing a surface of the intermediate transfer medium 50 stretched between the support rollers 14 and 15. The image forming units 18 form a tandem developing device 120. An irradiator 21 is disposed adjacent to the tandem developing device 120.

A secondary transfer device 22 is disposed on the opposite side of the tandem developing device 120 with respect to the intermediate transfer medium 50. The secondary transfer device 22 includes a seamless secondary transfer belt 24 stretched taut with a pair of rollers 23. A recording medium conveyed by the secondary transfer belt 24 is brought into contact with the intermediate transfer medium 50. A fixing device 25 is disposed adjacent to the secondary transfer device 22. The fixing device 25 includes a seamless fixing belt 26 and a pressing roller 27 pressed against the fixing belt 26. A sheet reversing device 28 adapted to reverse a sheet of recording medium in duplexing is disposed adjacent to the secondary transfer device 22 and the fixing device 25.

In the tandem developing device 120, a full-color image is produced in the manner described below. A document is set on a document table 130 of the automatic document feeder 400. Alternatively, a document is set on a contact glass 32 of the scanner 300 while lifting up the automatic document feeder 400, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light to the document and reflects a light reflected from the document toward the second runner 34. The second runner 34 then reflects the light toward a reading sensor 36 through an imaging lens 35. Thus, image information of black, magenta, cyan, and yellow is read.

The image information of yellow, cyan, magenta, and black are respectively transmitted to the image forming units 18Y, 18C, 18M, and 18K. The image forming units 18Y, 18C, 18M, and 18K form respective toner images of yellow, cyan, magenta, and black. As illustrated in FIG. 5, each of the image forming units 18 includes a photoreceptor 10, a charger 160 adapted to uniformly charge the photoreceptor 10, an irradiator adapted to irradiate the charged surface of the photoreceptor 10 with light L containing image information to form an electrostatic latent image, a developing device 61 adapted to develop the electrostatic latent image into a toner image, a transfer charger 62 adapted to transfer the toner image onto the intermediate transfer medium 50, a cleaner 63, and a neutralization lamp 64. The toner images of yellow, cyan, magenta, and black are sequentially transferred from the respective photoreceptors 10Y, 10M, 10C, and 10K onto the intermediate transfer medium 50 that is endlessly moving. Thus, the toner images of yellow, cyan, magenta, and black are superimposed on one another on the intermediate transfer medium 50, thus forming a composite full-color toner image.

On the other hand, upon pressing of the switch, one of paper feed rollers 142 starts rotating in the paper feed table 200 so that a sheet of a recording medium is fed from one of paper feed cassettes 144 in a paper bank 143. The sheet is separated by one of separation rollers 145 and fed to a paper feed path 146. Feed rollers 147 feed the sheet to a paper feed path 148 in the main body 150. The sheet is then stopped by a registration roller 49. Alternatively, a recording medium may be fed from a manual feed tray 54. In this case, a separation roller 58 separates a sheet of the recording medium and feeds it to a manual paper feed path 53. The sheet is then stopped by the registration roller 49. Although the registration roller 49 is generally grounded, the registration roller 49 can be supplied with a bias for the purpose of removing paper powders from the sheet. The registration roller 49 feeds the sheet to the gap between the intermediate transfer medium 50 and the secondary transfer belt 24 in synchronization with an entry of the composite full-color toner image formed on the intermediate transfer medium 50 into the gap. Thus, the composite full-color toner image is transferred onto the sheet. After the composite toner image is transferred, residual toner particles remaining on the intermediate transfer medium 50 are removed by the cleaner 17.

The sheet having the composite toner image thereon is fed from the secondary transfer device 22 to the fixing device 25. The fixing device 25 fixes the composite toner image on the sheet by application of heat and/or pressure. The sheet is then discharged by a discharge roller 56 to be stacked on the discharge tray 57. Alternatively, the switch claw 55 switches paper feed paths so that the sheet gets reversed in the sheet reversing device 28. After forming another toner image on the back side of the sheet, the sheet is discharged onto the discharge tray 57 by rotation of a discharge roller 56.

A process cartridge according to an embodiment includes at least an electrostatic latent image bearing member adapted to bear an electrostatic latent image and a developing device adapted to develop the electrostatic latent image into a toner image with the toner according to an embodiment. The process cartridge is detachably attachable to image forming apparatuses.

The developing device includes at least a developer container for containing the developer according to an embodiment and a developer bearing member adapted to bear and convey the developer in the developer container. The developing device may further include a toner layer regulator adapted to regulate the thickness of a toner layer on the developer bearing member.

Figure 6:
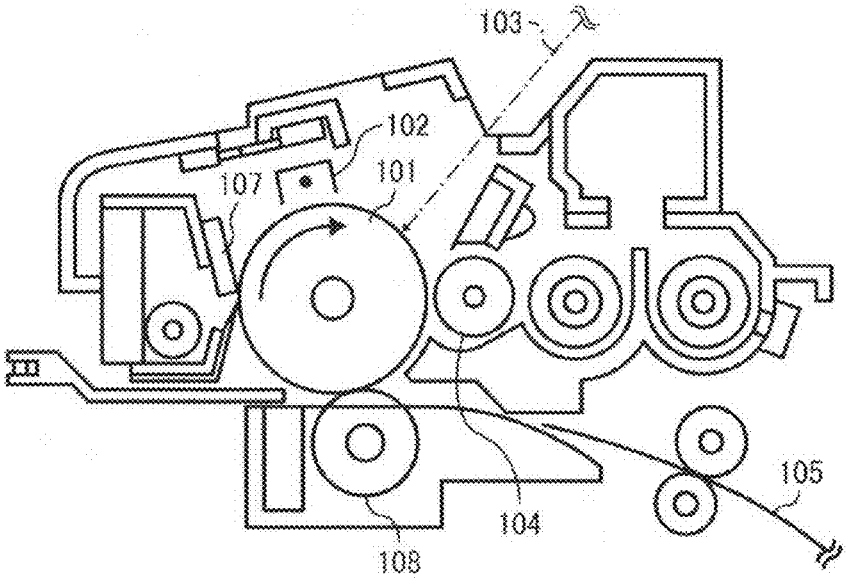
FIG. 6 is a schematic view of a process cartridge according to an embodiment.

FIG. 6 is a schematic view of a process cartridge according to an embodiment. The process cartridge includes an electrostatic latent image bearing member 101, a charger 102, a developing device 104, a transfer device 108, and a cleaner 107. In FIG. 6, a numeral 103 denotes a light beam emitted from an irradiator and a numeral 105 denotes a recording medium.

The electrostatic latent image bearing member 101 is charged by the charger 102 and then exposed to the light beam 103 emitted from the irradiator while rotating clockwise in FIG. 6. As a result, an electrostatic latent image is formed on the electrostatic latent image bearing member 101. The developing device 104 develops the electrostatic latent image into a toner image. The transfer device 108 transfers the toner image onto the recording medium 105. The cleaner 107 cleans the surface of the electrostatic latent image bearing member 101 after the toner image is transferred therefrom and a neutralizer further neutralizes the surface. The above-described procedures are repeated.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Measurement of Molecular Weight

Instrument: GPC (from Tosoh Corporation)
Detector: RI
Measurement temperature: 40° C.
Mobile phase: Tetrahydrofuran
Flow rate: 0.45 mL/min Number average molecular weight (Mn) and weight average molecular weight (Mw) are determined by GPC (gel permeation chromatography) with reference to a calibration curve complied from polystyrene standard samples having known molecular weights.

Measurement of Glass Transition Temperature (Tg)

Instrument: DSC (Q2000 from TA Instruments)

An aluminum simplified sealed pan is filled with 5 to 10 mg of a sample and is subjected to the following procedures.

1st heating: Heat from 3 to 220° C. at a heating rate of 5° C./min and keep at 220° C. for 1 minute.

Cooling: Quench to −60° C. without temperature control and keep at −60° C. for 1 minute.

2nd Heating: Heat from −60 to 180° C. at a heating rate of 5° C./min.

Glass transition temperature is determined from the midpoint observed in the thermogram obtained in the 2nd heating based on a method according to ASTM D3418/82. As to the first binder resin, a glass transition temperature observed in a lower temperature side is determined as Tg1 and that observed in a higher temperature side is determined as Tg2.

Measurement of Average of Maximum Feret Diameter

Instrument: AFM (MFP-3D from Asylum Technology Co., Ltd.)
Cantilever: OMCL-AC240TS-C3
Target amplitude: 0.5 V
Target percent: −5%
Amplitude set point: 315 mV
Scan rate: 1 Hz
Scan points: 256×256
Scan angle: 0°

A block of each sample (i.e., resin) is cut into an ultrathin section with an ultra microtome ULTRACUT (from Leica) under the following conditions. The ultrathin section is subjected to an observation with the AFM.

Cutting thickness: 60 nm
Cutting speed: 0.4 mm/sec
Cutting instrument: Diamond knife (Ultra Sonic 35°)

The obtained AFM phase image is binarized with an intermediate value between the maximum and minimum phase difference values. The binarized image has a first phase with greater phase differences (i.e., the soft low-Tg unit) and a second phase with smaller phase differences than the intermediate value. The binarized image has a size of 300 nm×300 nm. Among ten randomly-obtained binarized images, the first phase domains having the 1st to 30th largest maximum Feret diameter are chosen and their diameters are averaged.

Preparation of Resin 1

In a 300-ml reaction vessel equipped with a condenser tube, a stirrer, and a nitrogen inlet pipe, 250 g of a mixture of alcohol and acid constituents in a ratio described in Table 1 is contained. Titanium tetraisopropoxide in an amount of 1,000 ppm based on the resin constituents is also contained in the reaction vessel. The mixture is heated to 200° C. over a period of 4 hours, further heated to 230° C. over a period of 2 hours, and subjected to a reaction until no efflux is observed. The mixture is further subjected to a reaction for 5 hours under reduced pressures of 10 to 15 mmHg. Thus, a polyester initiator (1) is obtained.

Number average molecular weight (Mn) and glass transition temperature (Tg) of the polyester initiator (1) are shown in Table 2.

In an autoclave reaction vessel equipped with a thermometer and a stirrer, a mixture of the polyester initiator (1), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 1 is prepared. Molecular weights and glass transition temperatures of the resin 1 are shown in Table 3-1.

Preparation of Resin 2

The procedure for preparing the resin 1 is repeated except for changing the ratio of the polyester initiator (1) as described in Table 2. Thus, a resin 2 is prepared. Molecular weights and glass transition temperatures of the resin 2 are shown in Table 3-1.

Preparation of Resin 3

The procedure for preparing the polyester initiator (1) is repeated except for changing the ratio of the alcohol and acid constituents as described in Table 1. Thus, a polyester initiator (2) is prepared. Number average molecular weight (Mn) and glass transition temperature (Tg) of the polyester initiator (2) are shown in Table 2.

In an autoclave reaction vessel equipped with a thermometer and a stirrer, a mixture of the polyester initiator (2), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 3 is prepared. Molecular weights and glass transition temperatures of the resin 3 are shown in Table 3-1.

Preparation of Resin 4

The procedure for preparing the polyester initiator (1) is repeated except for changing the ratio of the alcohol and acid constituents as described in Table 1. Thus, a polyester initiator (3) is prepared. Number average molecular weight (Mn) and glass transition temperature (Tg) of the polyester initiator (3) are shown in Table 2.

In an autoclave reaction vessel equipped with a thermometer and a stirrer, a mixture of the polyester initiator (3), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 4 is prepared. Molecular weights and glass transition temperatures of the resin 4 are shown in Table 3-1.

Preparation of Resin 5

The procedure for preparing the polyester initiator (1) is repeated except for changing the ratio of the alcohol and acid constituents as described in Table 1. Thus, a polyester initiator (4) is prepared. Number average molecular weight (Mn) and glass transition temperature (Tg) of the polyester initiator (4) are shown in Table 2.

In an autoclave reaction vessel equipped with a thermometer and a stirrer, a mixture of the polyester initiator (4), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 5 is prepared. Molecular weights and glass transition temperatures of the resin 5 are shown in Table 3-1.

Preparation of Resin 6

The procedure for preparing the polyester initiator (1) is repeated except for changing the ratio of the alcohol and acid constituents as described in Table 1. Thus, a polyester initiator (5) is prepared. Number average molecular weight (Mn) and glass transition temperature (Tg) of the polyester initiator (5) are shown in Table 2.

In an autoclave reaction vessel equipped with a thermometer and a stirrer, a mixture of the polyester initiator (5), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 6 is prepared. Molecular weights and glass transition temperatures of the resin 6 are shown in Table 3-1.

Preparation of Resin 7

The procedure for preparing the polyester initiator (1) is repeated except for changing the ratio of the alcohol and acid constituents as described in Table 1. Thus, a polyester initiator (6) is prepared. Number average molecular weight (Mn) and glass transition temperature (Tg) of the polyester initiator (6) are shown in Table 2.

In an autoclave reaction vessel equipped with a thermometer and a stirrer, a mixture of the polyester initiator (6), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 7 is prepared. Molecular weights and glass transition temperatures of the resin 7 are shown in Table 3-1.

Preparation of Resin 8

The procedure for preparing the polyester initiator (1) is repeated except for changing the ratio of the alcohol and acid constituents as described in Table 1. Thus, a polyester initiator (7) is prepared. Number average molecular weight (Mn) and glass transition temperature (Tg) of the polyester initiator (7) are shown in Table 2.

In an autoclave reaction vessel equipped with a thermometer and a stirrer, a mixture of the polyester initiator (7), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 8 is prepared. Molecular weights and glass transition temperatures of the resin 8 are shown in Table 3-1.

Preparation of Resin 9

The procedure for preparing the resin 1 is repeated except for changing the ratio of the polyester initiator (1) as described in Table 2. Thus, a resin 9 is prepared. Molecular weights and glass transition temperatures of the resin 9 are shown in Table 3-1.

Preparation of Resin 10

The procedure for preparing the polyester initiator (1) is repeated except for changing the ratio of the alcohol and acid constituents as described in Table 1. Thus, a polyester initiator (8) is prepared. Number average molecular weight (Mn) and glass transition temperature (Tg) of the polyester initiator (8) are shown in Table 2.

In an autoclave reaction vessel equipped with a thermometer and a stirrer, a mixture of the polyester initiator (8), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 10 is prepared. Molecular weights and glass transition temperatures of the resin 10 are shown in Table 3-1.

Preparation of Resin 11

In an autoclave reaction vessel equipped with a thermometer and a stirrer, a mixture of a polyester polyol (DESMOPHEN 1200 from Sumitomo Bayer Urethane Co., Ltd., having a number average molecular weight of about 1,000 and a hydroxyl value of 165 mgKOH/g), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 11 is prepared. Molecular weights and glass transition temperatures of the resin 11 are shown in Table 3-1.

Preparation of Resin 12

In a reaction vessel equipped with a condenser, a stirrer, and a nitrogen inlet pipe, 43.8 parts of 1,2-propylene glycol, 44.8 parts of terephthalic acid dimethyl ester, 11.2 parts of adipic acid, and 0.2 parts of tetrabutoxy titanate, as a condensation catalyst, are contained. The mixture is subjected to a reaction for 8 hours at 180° C. and subsequent 4 hours at 230° C. under nitrogen gas flow. The mixture is further subjected to a reaction under reduced pressures of 5 to 20 mmHg until the softening point of the reaction product reaches 150° C. The resulting resin is cooled and pulverized. Thus, a polyester initiator (9) is prepared. Number average molecular weight (Mn) and glass transition temperature (Tg) of the polyester initiator (9) are shown in Table 2.

In an autoclave reaction vessel equipped with a thermometer and a stirrer, a mixture of the polyester initiator (9), L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 12 is prepared. Molecular weights and glass transition temperatures of the resin 12 are shown in Table 3-1.

Preparation of Resin 13

In an autoclave reaction vessel equipped with a thermometer and a stirrer, a mixture of lauryl alcohol, L-lactide, and D-lactide in a weight ratio described in Table 2, and 1% by weight of titanium terephthalate are contained. After substituting the air in the vessel with nitrogen gas, the mixture is subjected to a polymerization for 6 hours at 160° C. Thus, a resin 13 is prepared. Molecular weights and glass transition temperatures of the resin 13 are shown in Table 3-1.

The resins 1 to 13 are subjected to an observation with a tapping mode of AFM. The obtained phase image is binarized with an intermediate value between the maximum and minimum phase difference values. As to the resins 1 to 10, in each binarized image, the first phase is dispersed in the second phase. As to the resins 11 to 13, in each binarized image, the first phase is not dispersed in the second phase, i.e., domain of the first phase cannot be clearly distinguished from image noise and the Feret diameter cannot be determined. The averages of the maximum Feret diameters for the resins 1 to 10 are shown in Table 3-1.

Figure 9:
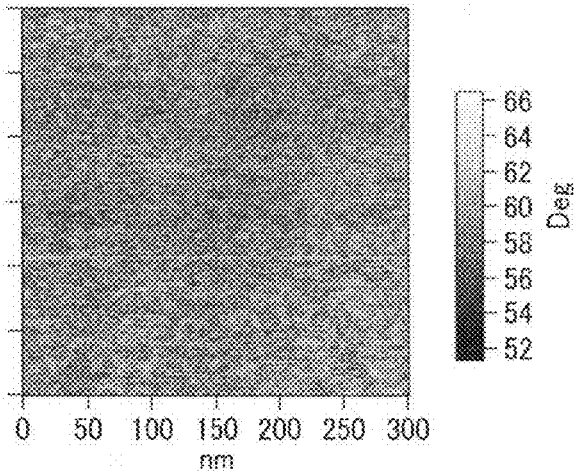
FIG. 9 is a phase image of a comparative resin obtained by the tapping mode of AFM.

FIG. 7 is a phase image of the resin 1 obtained by the tapping mode of AFM. FIG. 8 is a binarized image of the phase image illustrated in FIG. 7. FIG. 9 is a phase image of the resin 11 obtained by the tapping mode of AFM.

TABLE 1

| Polyester initiator No. | Alcohol constituents (mol %) 3-Methyl-1,5-pentanediol | 1,3-Propanediol | Neopentyl glycol | Acid constituents (mol %) Dimethyl adipate | Dimethyl terephthalate | Trimellitic anhydride | OH/COOH (by mol) |
|---|---|---|---|---|---|---|---|
| 1 | 70 | 30 | — | 80 | 17 | 3 | 1.2 |
| 2 | 30 | 70 | — | 80 | 17 | 3 | 1.3 |
| 3 | 30 | — | 70 | 80 | 17 | 3 | 1.3 |
| 4 | 50 | 50 | — | 80 | 17 | 3 | 1.15 |
| 5 | 70 | 30 | — | 37 | 60 | 3 | 1.2 |
| 6 | 70 | 30 | — | 80 | 18.5 | 1.5 | 1.2 |
| 7 | 70 | 30 | — | 80 | 20 | 0 | 1.2 |
| 8 | 70 | 30 | — | 47 | 50 | 3 | 1.2 |

TABLE 2

| Resin No. | Initiator | Initiator Mn | Initiator Tg (° C.) | Initiator Ratio (%) | L-Lactide Ratio (%) | D-Lactide Ratio (%) |
|---|---|---|---|---|---|---|
| 1 | Polyester initiator 1 | 3,800 | −7 | 30 | 59.5 | 10.5 |
| 2 | Polyester initiator 1 | 3,800 | −7 | 40 | 51 | 9 |
| 3 | Polyester initiator 2 | 4,900 | −6 | 30 | 56 | 14 |
| 4 | Polyester initiator 3 | 3,100 | 21 | 50 | 42.5 | 7.5 |
| 5 | Polyester initiator 4 | 5,500 | 10 | 40 | 51 | 9 |
| 6 | Polyester initiator 5 | 4,700 | −30 | 20 | 56 | 24 |
| 7 | Polyester initiator 6 | 4,100 | −10 | 30 | 59.5 | 10.5 |
| 8 | Polyester initiator 7 | 4,300 | −4 | 30 | 59.5 | 10.5 |

TABLE 2-continued

| Resin No. | Initiator | Initiator Mn | Initiator Tg (° C.) | Initiator Ratio (%) | L-Lactide Ratio (%) | D-Lactide Ratio (%) |
|---|---|---|---|---|---|---|
| 9 | Polyester initiator 1 | 3,800 | −7 | 60 | 34 | 6 |
| 10 | Polyester initiator 8 | 4,800 | −38 | 20 | 68 | 12 |
| 11 | DESMOPHEN 1200 | 1,000 | −50 | 10 | 76.5 | 13.5 |
| 12 | Polyester initiator 9 | 2,000 | 49 | 33 | 50 | 17 |
| 13 | Lauryl alcohol | 186 | — | 1.3 | 50 | 48.7 |

Example 1

Preparation of Resin Particle Dispersion W

In a reaction vessel equipped with a stirrer and a thermometer, 600 parts of water, 120 parts of styrene, 100 parts of methacrylic acid, 45 parts of butyl acrylate, 10 parts of a sodium alkylallylsulfosuccinate (ELEMINOL JS-2 from Sanyo Chemical Industries, Ltd.), and 1 part of ammonium persulfate are agitated for 20 minutes at a revolution of 400 rpm. Thus, a white emulsion is prepared. The white emulsion is heated to 75° C. and subjected to a reaction for 8 hours.

A 1% aqueous solution of ammonium persulfate in an amount of 30 parts is further added to the emulsion, and the mixture is aged for 6 hours at 75° C. Thus, a resin particle dispersion W that is an aqueous dispersion of a vinyl resin (i.e., a copolymer of styrene, methacrylic acid, butyl acrylate, and sodium alkylallylsulfosuccinate) is prepared.

The resin particles dispersed in the resin particle dispersion W have a volume average particle diameter of 0.08 μm measured by ELS-800.

The dried resin particles separated from the resin particle dispersion W have a glass transition temperature of 74° C. measured by a flow tester.

Preparation of Aqueous Medium

An aqueous medium is prepared by uniformly mixing and agitating 300 parts of ion-exchange water, 300 parts of the resin particle dispersion W, and 0.2 parts of sodium dodecylbenzenesulfonate.

Preparation of Master Batch

First, 1,000 parts of water, 530 parts of a carbon black (PRINTEX 35 from Degussa) having a DBP oil absorption of 42 ml/100 g and a pH of 9.5, and 1,200 parts of the resin 1 are mixed by a HENSCHEL MIXER (from Mitsui Mining and Smelting Co., Ltd.).

The resulting mixture is kneaded for 30 minutes at 150° C. by double rolls, the kneaded mixture is then rolled and cooled, and the rolled mixture is then pulverized into particles by a pulverizer (from Hosokawa Micron Corporation). Thus, a master batch is prepared.

Preparation of Toner

A resin solution 1 is prepared by mixing 100 parts of the resin 1 with 100 parts of ethyl acetate in a reaction vessel.

A carnauba wax (having a molecular weight of 1,800, an acid value of 2.7 mgKOH/g, and a penetration of 1.7 mm (at 40° C.)) in an amount of 5 parts and the master batch in an amount of 5 parts are dispersed in the resin solution 1 by a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 msec. This dispersing operation is repeated 3 times (3 passes). Thus, a toner constituents liquid is prepared.

In a vessel, 150 parts of the aqueous medium are mixed with 100 parts of the toner constituents liquid for 10 minutes by a TK HOMOMIXER (from PRIMIX Corporation) at a revolution of 12,000 rpm. Thus, an emulsion slurry is prepared.

A flask equipped with a stirrer and a thermometer is charged with 100 parts of the emulsion slurry. The emulsion slurry is agitated for 10 hours at 30° C. at a peripheral speed of 20 m/min so that the solvents are removed therefrom. Thus, a dispersion slurry is prepared.

Next, 100 parts of the dispersion slurry is filtered under reduced pressures to obtain a wet cake (i). The wet cake (i) is then mixed with 100 parts of ion-exchange water by a TK HOMOMIXER for 10 minutes at a revolution of 12,000 rpm, followed by filtration, thus obtaining a wet cake (ii).

The wet cake (ii) is mixed with 300 parts of ion-exchange water by a TK HOMOMIXER for 10 minutes at a revolution of 12,000 rpm, followed by filtration. This operation is repeated twice, thus obtaining a wet cake (iii). The wet cake (iii) is mixed with 20 parts of a 10% aqueous solution of sodium hydroxide by a TK HOMOMIXER for 30 minutes at a revolution of 12,000 rpm, followed by filtration under reduced pressures, thus obtaining a wet cake (iv). The wet cake (iv) is mixed with 300 parts of ion-exchange water by a TK HOMOMIXER for 10 minutes at a revolution of 12,000 rpm, followed by filtration, thus obtaining a wet cake (v). The wet cake (v) is mixed with 300 parts of ion-exchange water by a TK HOMOMIXER for 10 minutes at a revolution of 12,000 rpm, followed by filtration. This operation is repeated twice, thus obtaining a wet cake (vi). The wet cake (vi) is mixed with 20 parts of a 10% hydrochloric acid by a TK HOMOMIXER for 10 minutes at a revolution of 12,000 rpm. Thereafter, a 5% methanol solution of a fluorine-containing quaternary ammonium salt (FTERGENT F-310 from Neos Company Limited) is added so that the resulting mixture includes 0.1 parts of the fluorine-containing quaternary ammonium salt based on 100 parts of the solid constituents. The mixture is further agitated for 10 minutes, followed by filtration, thus obtaining a wet cake (vii). The wet cake (vii) is mixed with 300 parts of ion-exchange water by a TK HOMOMIXER for 10 minutes at a revolution of 12,000 rpm, followed by filtration. This operation is repeated twice, thus obtaining a wet cake (viii).

The wet cake (viii) is dried by a circulating drier for 36 hours at 40° C. and filtered with a mesh having openings of 75 μm. Thus, a mother toner 1 is prepared. The mother toner 1 in an amount of 100 parts is mixed with 1.5 parts of a hydro phobized silica (TS720 from Cabot Corporation) by a HENSCHEL MIXER for 5 minutes at a revolution of 3,000 rpm. Thus, a toner 1 is prepared.

Examples 2 to 8

The procedure for preparing the toner 1 is repeated except that the resin 1 is replaced with each of the resins 2 to 8. Thus, toners 2 to 8 are prepared.

Comparative Examples 1 to 5

The procedure for preparing the toner 1 is repeated except that the resin 1 is replaced with each of the resins 9 to 13. Thus, comparative toners 9 to 13 are prepared.

Preparation of Carrier

A coating layer forming liquid is prepared by dispersing 100 parts of a silicone resin (SR2411 from Dow Corning Toray Co., Ltd.), 5 parts of γ-(2-aminoethyl)aminopropyl trimethoxysilane, and 10 parts of a carbon black in 100 parts of toluene by a homomixer for 20 minutes. The coating layer forming liquid is applied to the surfaces of 1,000 parts of magnetite particles having a volume average particle diameter of 50 μm using a fluidized bed coating device. Thus, a magnetic carrier is prepared.

Preparation of Developers

Each of the toners 1 to 8 and comparative toners 9 to 13 in an amount of 5 parts and the carrier in an amount of 95 parts are mixed with a ball mill. Thus, two-component developers 1 to 8 and comparative two-component developers 9 to 13 are prepared.

These two-component developers are subjected to the following evaluations of (a) image density, (b) heat-resistant storage stability, and (c) fixability. The evaluation results are shown in Table 3-2.

(a) Evaluation of Image Density

Each developer is mounted on a tandem full-color electrophotographic apparatus (IMAGIO NEO 450 from Ricoh Co., Ltd.), and a solid image having 1.00±0.05 mg/cm$^2$ of toner is formed on a sheet of a paper TYPE 6000 <70 W> (from Ricoh Co., Ltd.) while setting the temperature of the fixing roller to 160±2° C. Six randomly-selected portions in the solid image are subjected to a measurement of image density with a spectrophotometer (938 spectrodensitometer from X-Rite). The measured image density values are averaged and graded as follows.

Image Density Grades

A: not less than 2.0

B: not less than 1.70 and less than 2.0

C: less than 1.70

(b) Evaluation of Heat-Resistant Storage Stability (Penetration)

A 50-ml glass vial is filled with each toner and left in a constant-temperature chamber at 50° C. for 24 hours, followed by cooling to 24° C. The toner is then subjected to a penetration test based on JIS K-2235-1991. Penetration (mm) represents how deep the needle penetrates the above toner in the vial. The greater the penetration, the better the heat-resistant storage stability of the toner. A toner with a penetration less than 5 mm may be not commercially viable.

Penetration Grades

A+: not less than 25 mm

A: not less than 15 mm and less than 25 mm

B: not less than 5 mm and less than 15 mm

C: less than 5 mm (c) Evaluation of Fixability

A copier (MF-200 from Ricoh Co., Ltd.) employing a TEFLON® fixing roller is modified so that the temperature of the fixing roller is variable. Each developer is mounted on the copier, and a solid image having 0.85±0.1 mg/cm$^2$ of toner is formed on sheets of a normal paper TYPE 6200 (from Ricoh Co., Ltd.) and a thick paper <135> (from NBS Ricoh) while varying the temperature of the fixing roller to determine the maximum and minimum fixable temperatures. The maximum fixable temperature is a temperature above which hot offset occurs on the normal paper. The minimum fixable temperature is a temperature below which the residual rate of image density after rubbing the solid image falls below 70% on the thick paper.

Maximum Fixable Temperature Grades

A+: not less than 190° C.

A: not less than 180° C. and less than 190° C.

B: not less than 170° C. and less than 180° C.

C: less than 170° C.

Minimum Fixable Temperature Grades

A+: less than 120° C.

A: not less than 130° C. and less than 130° C.

B: not less than 130° C. and less than 140° C.

C: not less than 140° C.

TABLE 3

| | Toner No. | Resin No. | Resin Mn | Resin Mw | Tg1 (° C.) | Tg2 (° C.) | h1/h2 | Average of maximum Feret diameters (nm) |
|---|---|---|---|---|---|---|---|---|
| Example 1 | 1 | 1 | 16,000 | 35,000 | 6 | 40 | 0.2 | 50 |
| Example 2 | 2 | 2 | 10,000 | 26,000 | 7 | 37 | 0.3 | 75 |
| Example 3 | 3 | 3 | 19,000 | 42,000 | 3 | 42 | 0.25 | 55 |
| Example 4 | 4 | 4 | 12,000 | 30,000 | 20 | 42 | 0.41 | 80 |
| Example 5 | 5 | 5 | 10,000 | 23,000 | 11 | 44 | 0.33 | 70 |
| Example 6 | 6 | 6 | 22,000 | 40,000 | −18 | 43 | 0.16 | 65 |
| Example 7 | 7 | 7 | 17,000 | 28,000 | 4 | 41 | 0.21 | 69 |
| Example 8 | 8 | 8 | 16,000 | 31,000 | 8 | 39 | 0.22 | 95 |
| Comparative Example 1 | 9 | 9 | 11,000 | 21,000 | 12 | 40 | 1.2 | 150 |
| Comparative Example 2 | 10 | 10 | 20,000 | 38,000 | −27 | 43 | 0.18 | 70 |
| Comparative Example 3 | 11 | 11 | 10,000 | 22,000 | — | 42 | — | N/A |
| Comparative Example 4 | 12 | 12 | 12,000 | 29,000 | — | 45 | — | N/A |
| Comparative | 13 | 13 | 12,000 | 25,000 | — | 45 | — | N/A |

TABLE 3-continued

Example 5

| | Toner No. | Image density | Fixability | | Heat-resistant storage stability |
|---|---|---|---|---|---|
| | | | Minimum fixable temperature | Maximum fixable temperature | |
| Example 1 | 1 | A | A+ | A+ | A+ |
| Example 2 | 2 | A | A+ | A | A+ |
| Example 3 | 3 | A | A+ | A+ | A |
| Example 4 | 4 | A | A+ | A+ | A+ |
| Example 5 | 5 | A | A+ | A | A |
| Example 6 | 6 | A | A+ | A+ | A |
| Example 7 | 7 | A | A+ | A+ | A |
| Example 8 | 8 | A | A+ | A+ | B |
| Comparative Example 1 | 9 | B | A | A | C |
| Comparative Example 2 | 10 | A | A+ | B | C |
| Comparative Example 3 | 11 | B | C | A | A+ |
| Comparative Example 4 | 12 | A | B | A+ | A+ |
| Comparative Example 5 | 13 | C | C | B | C |

Referring to Table 3, as to Examples 1 to 8, the glass transition temperatures Tg1 and Tg2 are observed within a desired temperature range and the average of the maximum Feret diameters is less than 100 nm. These toners have a good combination of low-temperature fixability, a wide fixable temperature range, and heat-resistant storage stability. As to Comparative Example 1, the ratio of the low-Tg unit is too high, i.e., h1/h2 exceeds 1.0, and the average of the maximum Feret diameter of the low-Tg unit exceeds 100 nm. This toner has a relatively low minimum fixable temperature but heat-resistant storage stability is poor. This may be because the low-Tg unit is exposed at the surface of the toner. As to the comparative toner 2, h1/h2 and the average of the maximum Feret diameter are each relatively low and the low-Tg unit is finely dispersed, but Tg1 is too low to keep good storage stability. As to Comparative Example 3, Tg of the backbone B in the initiator is sufficiently low but it is clear from the results of DSC and AFM that the low-Tg unit is not finely dispersed in the resin. This toner is poor at low-temperature fixability. As to Comparative Example 4, Tg of the backbone B in the initiator is too high. It is clear from the AFM result that the resin does not take a structure in which soft portions are dispersed in hard portions. This toner is poor at low-temperature fixability. As to Comparative Example 5 including a polylactic acid resin obtained by a ring-opening polymerization, the resin does not have a phase-separated structure. This toner does not have sufficient low-temperature fixability and heat-resistant storage stability.

Preparation of First Binder Resins

Preparation of Polyester Initiator 101

In a 300-ml reaction vessel equipped with a condenser tube, a stirrer, and a nitrogen inlet pipe, 250 g of a mixture of alcohol and acid constituents in a ratio described in Table 4 is contained. Titanium tetraisopropoxide in an amount of 1,000 ppm based on the resin constituents is also contained in the reaction vessel. The mixture is heated to 200° C. over a period of 4 hours, further heated to 230° C. over a period of 2 hours, and subjected to a reaction until no efflux is observed. The mixture is further subjected to a reaction for 5 hours under reduced pressures of 10 to 15 mmHg. Thus, a polyester initiator 101 is obtained.

Preparation of Polyester Initiator 102

The procedure for preparing the polyester initiator 101 is repeated except for changing the ratio of the alcohol and acid constituents as described in Table 4. Thus, a polyester initiator 102 is prepared.

Preparation of Polyester Initiator 103

The procedure for preparing the polyester initiator 101 is repeated except for changing the ratio of the alcohol and acid constituents as described in Table 4. Thus, a polyester initiator 103 is prepared.

Preparation of Polyester Initiator 104

The procedure for preparing the polyester initiator 101 is repeated except for changing the ratio of the alcohol and acid constituents as described in Table 4. Thus, a polyester initiator 104 is prepared.

Preparation of Polyester Initiator 105

The procedure for preparing the polyester initiator 101 is repeated except for changing the ratio of the alcohol and acid constituents as described in Table 4. Thus, a polyester initiator 105 is prepared.

Preparation of Polyester Initiator 106

The procedure for preparing the polyester initiator 101 is repeated except for changing the ratio of the alcohol and acid constituents as described in Table 4. Thus, a polyester initiator 106 is prepared.

Preparation of Polyester Initiator 107

The procedure for preparing the polyester initiator 101 is repeated except for changing the ratio of the alcohol and acid constituents as described in Table 4. Thus, a polyester initiator 107 is prepared.

Preparation of Polyester Initiator 108

The procedure for preparing the polyester initiator 101 is repeated except for changing the ratio of the alcohol and acid constituents as described in Table 4. Thus, a polyester initiator 108 is prepared.

Preparation of Polyester Initiator 109

The procedure for preparing the polyester initiator 101 is repeated except for changing the ratio of the alcohol and acid constituents as described in Table 4. Thus, a polyester initiator 109 is prepared.

Preparation of Polyester Initiator 110

The procedure for preparing the polyester initiator 101 is repeated except for changing the ratio of the alcohol and acid constituents as described in Table 4. Thus, a polyester initiator 110 is prepared.

Preparation of Polyester Initiator 111

The procedure for preparing the polyester initiator 101 is repeated except for changing the ratio of the alcohol and acid constituents as described in Table 4. Thus, a polyester initiator 111 is prepared.

TABLE 4

| Polyester initiator No. | Alcohol constituents (mol %) 3-Methyl-1,5-pentanediol | 1,3-Propanediol | Neopentyl glycol | Acid constituents (mol %) Dimethyl adipate | Dimethyl terephthalate | Trimellitic anhydride |
|---|---|---|---|---|---|---|
| 101 | 84 | 36 | 0 | 77.6 | 19.4 | 3 |
| 102 | 39 | 91 | 0 | 77.6 | 19.4 | 3 |
| 103 | 39 | 0 | 91 | 77.6 | 19.4 | 3 |
| 104 | 57.5 | 57.5 | 0 | 77.6 | 19.4 | 3 |
| 105 | 84 | 36 | 0 | 38.8 | 58.2 | 3 |
| 106 | 78 | 52 | 0 | 77.6 | 19.4 | 3 |
| 107 | 84 | 36 | 0 | 78.8 | 19.7 | 1.5 |
| 108 | 84 | 36 | 0 | 79 | 19.8 | 1.2 |
| 109 | 84 | 36 | 0 | 80 | 20 | 0 |
| 110 | 84 | 36 | 0 | 48.5 | 48.5 | 3 |
| 111 | 75 | 50 | 0 | 77.6 | 19.4 | 3 |

Preparation of Polyester Initiator 112

In a reaction vessel equipped with a condenser, a stirrer, and a nitrogen inlet pipe, 43.8 parts of 1,2-propylene glycol, 44.8 parts of terephthalic acid dimethyl ester, 11.2 parts of adipic acid, and 0.2 parts of tetrabutoxy titanate, as a condensation catalyst, are contained. The mixture is subjected to a reaction for 8 hours at 180° C. and subsequent 4 hours at 230° C. under nitrogen gas flow. The mixture is further subjected to a reaction under reduced pressures of 5 to 20 mmHg until the softening point of the reaction product reaches 150° C. The resulting resin is cooled and pulverized. Thus, a polyester initiator 112 is prepared.

Properties of the polyester initiators 101 to 112 are shown in Table 5.

TABLE 5

| Polyester initiator No. | Mn | Tg (° C.) |
|---|---|---|
| 101 | 3,800 | −7 |
| 102 | 4,900 | −6 |
| 103 | 3,100 | 21 |
| 104 | 5,500 | 10 |
| 105 | 4,700 | −30 |
| 106 | 2,900 | 3 |
| 107 | 4,100 | −10 |
| 108 | 4,200 | 1 |
| 109 | 4,300 | −4 |
| 110 | 4,800 | −38 |
| 111 | 3,500 | 4 |
| 112 | 2,000 | 49 |

Preparation of Resin 101

In an autoclave reaction vessel equipped with a thermometer and a stirrer, a mixture of the polyester initiator 101, L-lactide, and D-lactide in a weight ratio described in Table 6, and 1% by weight of titanium terephthalate are contained. After substituting the air in the vessel with nitrogen gas, the mixture is subjected to a polymerization for 6 hours at 160° C. Thus, a resin 101 is prepared.

Preparation of Resin 102

The procedure for preparing the first binder resin 101 is repeated except for changing the kind and/or ratio of the polyester initiator and lactides as described in Table 6. Thus, a resin 102 is prepared.

Preparation of Resin 103

The procedure for preparing the first binder resin 101 is repeated except for changing the kind and/or ratio of the polyester initiator and lactides as described in Table 6. Thus, a resin 103 is prepared.

Preparation of Resin 104

The procedure for preparing the first binder resin 101 is repeated except for changing the kind and/or ratio of the polyester initiator and lactides as described in Table 6. Thus, a resin 104 is prepared.

Preparation of Resin 105

The procedure for preparing the first binder resin 101 is repeated except for changing the kind and/or ratio of the polyester initiator and lactides as described in Table 6. Thus, a resin 105 is prepared.

Preparation of Resin 106

The procedure for preparing the first binder resin 101 is repeated except for changing the kind and/or ratio of the polyester initiator and lactides as described in Table 6. Thus, a resin 106 is prepared.

Preparation of Resin 107

The procedure for preparing the first binder resin 101 is repeated except for changing the kind and/or ratio of the polyester initiator and lactides as described in Table 6. Thus, a resin 107 is prepared.

Preparation of Resin 108

The procedure for preparing the first binder resin 101 is repeated except for changing the kind and/or ratio of the polyester initiator and lactides as described in Table 6. Thus, a resin 108 is prepared.

Preparation of Resin 109

The procedure for preparing the first binder resin 101 is repeated except for changing the kind and/or ratio of the polyester initiator and lactides as described in Table 6. Thus, a resin 109 is prepared.

Preparation of Resin 110

The procedure for preparing the first binder resin 101 is repeated except for changing the kind and/or ratio of the polyester initiator and lactides as described in Table 6. Thus, a resin 110 is prepared.

Preparation of Resin 111

The procedure for preparing the first binder resin 101 is repeated except for changing the kind and/or ratio of the polyester initiator and lactides as described in Table 6. Thus, a resin 111 is prepared.

Preparation of Resin 112

The procedure for preparing the first binder resin 101 is repeated except for changing the kind and/or ratio of the polyester initiator and lactides as described in Table 6. Thus, a resin 112 is prepared.

Preparation of Resin 113

The procedure for preparing the first binder resin 101 is repeated except for changing the kind and/or ratio of the polyester initiator and lactides as described in Table 6. Thus, a resin 113 is prepared.

Preparation of Resin 114

The procedure for preparing the first binder resin 101 is repeated except for changing the kind and/or ratio of the polyester initiator and lactides as described in Table 6. Thus, a resin 114 is prepared.

Preparation of Resin 115

The procedure for preparing the first binder resin 101 is repeated except for changing the kind and/or ratio of the polyester initiator and lactides as described in Table 6. Thus, a resin 115 is prepared.

Preparation of Resin 116

The procedure for preparing the first binder resin 101 is repeated except for changing the kind and/or ratio of the polyester initiator and lactides as described in Table 6. Thus, a resin 116 is prepared.

TABLE 6

| Resin No. | Initiator | Initiator Ratio (%) | L-Lactide Ratio (%) | D-Lactide Ratio (%) |
|---|---|---|---|---|
| 101 | Polyester initiator 101 | 30 | 59.5 | 10.5 |
| 102 | Polyester initiator 101 | 40 | 51 | 9 |
| 103 | Polyester initiator 102 | 30 | 56 | 14 |
| 104 | Polyester initiator 103 | 50 | 42.5 | 7.5 |
| 105 | Polyester initiator 104 | 40 | 51 | 9 |
| 106 | Polyester initiator 105 | 20 | 56 | 24 |
| 107 | Polyester initiator 106 | 50 | 42.5 | 7.5 |
| 108 | Polyester initiator 107 | 30 | 59.5 | 10.5 |
| 109 | Polyester initiator 108 | 30 | 59.5 | 10.5 |
| 110 | Polyester initiator 109 | 30 | 59.5 | 10.5 |
| 111 | Polyester initiator 101 | 60 | 34 | 6 |
| 112 | Polyester initiator 110 | 20 | 68 | 12 |
| 113 | Polyester initiator 111 | 30 | 59.5 | 10.5 |
| 114 | DESMOPHEN 1200 (*) | 10 | 76.5 | 13.5 |
| 115 | Polyester initiator 112 | 33 | 50.3 | 16.8 |
| 116 | Lauryl alcohol | 1.3 | 49.4 | 49.4 |

*DESMOPHEN 1200 is a polyester polyol available from Sumitomo Bayer Urethane Co., Ltd., having a number average molecular weight of about 1,000 and a hydroxyl value of 165 mgKOH/g.

Properties of the resins 101 to 116 are shown in Table 7.

TABLE 7

| Resin No. | Mn | Tg1 (° C.) | Tg2 (° C.) | h1/h2 | Average of maximum Feret diameters (nm) |
|---|---|---|---|---|---|
| 101 | 16,000 | 6 | 40 | 0.2 | 50 |
| 102 | 10,000 | 7 | 37 | 0.3 | 75 |
| 103 | 19,000 | 3 | 42 | 0.25 | 55 |
| 104 | 12,000 | 20 | 42 | 0.41 | 80 |
| 105 | 10,000 | 11 | 44 | 0.33 | 70 |
| 106 | 22,000 | −18 | 43 | 0.16 | 65 |
| 107 | 15,000 | 10 | 45 | 0.4 | 53 |
| 108 | 17,000 | 4 | 41 | 0.21 | 69 |
| 109 | 19,000 | 10 | 43 | 0.24 | 80 |
| 110 | 16,000 | 8 | 39 | 0.22 | 95 |
| 111 | 11,000 | 15 | 40 | 1.2 | 150 |
| 112 | 20,000 | −27 | 43 | 0.18 | 70 |
| 113 | 19,000 | 25 | 46 | 0.22 | 60 |
| 114 | 10,000 | — | 42 | — | N/A |
| 115 | 12,000 | — | 45 | — | N/A |
| 116 | 12,000 | — | 45 | — | N/A |

Preparation of Second Binder Resins

Preparation of Resin A

In a 300-ml reaction vessel equipped with a condenser tube, a stirrer, and a nitrogen inlet pipe, 250 g of a mixture of alcohol and acid constituents in a ratio described in Table 8 is contained. Titanium tetraisopropoxide in an amount of 1,000 ppm based on the resin constituents is also contained in the reaction vessel. The mixture is heated to 200° C. over a period of 4 hours, further heated to 230° C. over a period of 2 hours, and subjected to a reaction until no efflux is observed. The mixture is further subjected to a reaction for 5 hours under reduced pressures of 10 to 15 mmHg. Thus, a resin A is obtained.

Preparation of Resin B

The procedure for preparing the resin A is repeated except for changing the ratio of the alcohol and acid constituents as described in Table 8. Thus, a resin B is prepared.

Preparation of Resin C

The procedure for preparing the resin A is repeated except for changing the ratio of the alcohol and acid constituents as described in Table 8. Thus, a resin C is prepared.

Preparation of Resin D

The procedure for preparing the resin A is repeated except for changing the ratio of the alcohol and acid constituents as described in Table 8. Thus, a resin D is prepared.

Preparation of Resin E

The procedure for preparing the resin A is repeated except for changing the ratio of the alcohol and acid constituents as described in Table 8. Thus, a resin E is prepared.

Preparation of Resin I Precursor 1

The procedure for preparing the resin A is repeated except for changing the ratio of the alcohol and acid constituents as described in Table 8. Thus, a resin I precursor 1 is prepared.

Preparation of Resin J Precursor 1

The procedure for preparing the resin A is repeated except for changing the ratio of the alcohol and acid constituents as described in Table 8. Thus, a resin J precursor 1 is prepared.

Preparation of Resin L

The procedure for preparing the resin A is repeated except for changing the ratio of the alcohol and acid constituents as described in Table 8. Thus, a resin L is prepared.

Preparation of Resin M

The procedure for preparing the resin A is repeated except for changing the ratio of the alcohol and acid constituents as described in Table 8. Thus, a resin M is prepared.

TABLE 8

| | Alcohol constituents (mol %) | | | Acid constituents (mol %) | | |
|---|---|---|---|---|---|---|
| Resin No. | 3-Methyl-1,5-pentanediol | 1,3-Propanediol | Neopentyl glycol | Dimethyl adipate | Dimethyl terephthalate | Trimellitic anhydride |
| A | 54 | 54 | 0 | 77.6 | 19.4 | 3 |
| B | 42 | 63 | 0 | 77.6 | 19.4 | 3 |
| C | 66 | 44 | 0 | 77.6 | 19.4 | 3 |
| D | 64.8 | 43.2 | 0 | 78.8 | 19.7 | 1.5 |
| E | 66 | 44 | 0 | 79 | 19.8 | 1.2 |
| F | 79.1 | 33.9 | 0 | 80 | 20 | 0 |
| G | 67.8 | 45.2 | 0 | 77.6 | 19.4 | 3 |
| H Precursor 1 | 91 | 39 | 0 | 77.6 | 19.4 | 3 |
| I Precursor 1 | 78 | 52 | 0 | 77.6 | 19.4 | 3 |
| J Precursor 1 | 84.5 | 45.5 | 0 | 77.6 | 19.4 | 3 |
| L | 80.5 | 34.5 | 0 | 77.6 | 19.4 | 3 |
| M | 30.6 | 0 | 71.4 | 77.6 | 19.4 | 3 |

Preparation of Resin F

The procedure for preparing the resin A is repeated except for changing the ratio of the alcohol and acid constituents as described in Table 8. Thus, a resin F is prepared.

Preparation of Resin G

The procedure for preparing the resin A is repeated except for changing the ratio of the alcohol and acid constituents as described in Table 8. Thus, a resin G is prepared.

Preparation of Resin H Precursor 1

The procedure for preparing the resin A is repeated except for changing the ratio of the alcohol and acid constituents as described in Table 8. Thus, a resin H precursor 1 is prepared.

Preparation of Resin K

In an autoclave reaction vessel equipped with a thermometer and a stirrer, a mixture of 2.1 parts of lauryl alcohol, 85 parts of L-lactide, and 15 parts of D-lactide, and 1% by weight of titanium terephthalate are contained. After substituting the air in the vessel with nitrogen gas, the mixture is subjected to a polymerization for 6 hours at 160° C. Thus, a resin K is prepared.

Properties of the resins A to G, resin H precursor 1, resin I precursor 1, resin J precursor 1, and resins K to M are shown in Table 9.

TABLE 9

| Resin No. | Mn | Tg3 (° C.) |
|---|---|---|
| A | 15,000 | 8 |
| B | 20,000 | 10 |
| C | 10,000 | 5 |
| D | 13,000 | 7 |
| E | 11,000 | 6 |
| F | 8,000 | −4 |
| G | 9,500 | 4 |
| H Precursor 1 | 3,000 | −5 |
| I Precursor 1 | 3,000 | 2 |
| J Precursor 1 | 3,000 | −3 |
| L | 6,000 | −10 |
| M | 27,000 | 18 |
| K | 9,000 | 40 |

Preparation of Resin H Precursor 2
(Prepolymerization of Resin H Precursor 1)

A flask is charged with 100 parts of the resin H precursor 1 and the inner temperature is gradually increased. After it is confirmed that the reaction system is homogenized, the reaction system is subjected to dewatering under reduced pressure. The reaction system is supplied with ethyl acetate to have a concentration of 50%. Further, the reaction system is supplied with 0.20 parts of tin 2-ethylhexanoate and 22 parts of isophorone diisocyanate and is kept at 80° C. to cause a reaction. Thus, a resin H precursor 2 is prepared.

Preparation of Resin I Precursor 2

Prepolymerization of Resin I Precursor 1

A flask is charged with 100 parts of the resin I precursor 1 and the inner temperature is gradually increased. After it is confirmed that the reaction system is homogenized, the reaction system is subjected to dewatering under reduced pressure. The reaction system is supplied with ethyl acetate to have a concentration of 50%. Further, the reaction system is supplied with 0.20 parts of tin 2-ethylhexanoate and 16 parts of hexamethylene diisocyanate and is kept at 80° C. to cause a reaction. Thus, a resin I precursor 2 is prepared.

Preparation of Resin J Precursor 2

Prepolymerization of Resin J Precursor 1

A flask is charged with 100 parts of the resin J precursor 1 and the inner temperature is gradually increased. After it is confirmed that the reaction system is homogenized, the reaction system is subjected to dewatering under reduced pressure. The reaction system is supplied with ethyl acetate to have a concentration of 50%. Further, the reaction system is supplied with 0.20 parts of tin 2-ethylhexanoate and 22 parts of isophorone diisocyanate and is kept at 80° C. to cause a reaction. Thus, a resin J precursor 2 is prepared.

Example 101

Preparation of Master Batch

First, 1,000 parts of water, 530 parts of a carbon black (PRINTEX 35 from Degussa) having a DBP oil absorption of 42 ml/100 g and a pH of 9.5, and 1,200 parts of the resin 101 are mixed by a HENSCHEL MIXER (from Mitsui Mining and Smelting Co., Ltd.).

The resulting mixture is kneaded for 30 minutes at 150° C. by double rolls, the kneaded mixture is then rolled and cooled, and the rolled mixture is then pulverized into particles by a pulverizer (from Hosokawa Micron Corporation). Thus, a master batch is prepared.

Preparation of Ketimine Compound

In a reaction vessel equipped with a stirrer and a thermometer, 30 parts of isophoronediamine and 70 parts of methyl ethyl ketone are subjected to a reaction for 5 hours at 50° C. Thus, a ketimine compound is prepared. The ketimine compound has an amine value of 423 mgKOH/g.

Preparation of Resin Particle Dispersion W

In a reaction vessel equipped with a stirrer and a thermometer, 600 parts of water, 120 parts of styrene, 100 parts of methacrylic acid, 45 parts of butyl acrylate, 10 parts of a sodium alkylallylsulfosuccinate (ELEMINOL JS-2 from Sanyo Chemical Industries, Ltd.), and 1 part of ammonium persulfate are agitated for 20 minutes at a revolution of 400 rpm. Thus, a white emulsion is prepared.

The white emulsion is heated to 75° C. and subjected to a reaction for 6 hours.

A 1% aqueous solution of ammonium persulfate in an amount of 30 parts is further added to the emulsion, and the mixture is aged for 6 hours at 75° C. Thus, a resin particle dispersion W that is an aqueous dispersion of a vinyl resin (i.e., a copolymer of styrene, methacrylic acid, butyl acrylate, and sodium alkylallylsulfosuccinate) is prepared.

The resin particles dispersed in the resin particle dispersion W have a volume average particle diameter of 0.08 μm measured by ELS-800.

The dried resin particles separated from the resin particle dispersion W have a glass transition temperature of 74° C. measured by a flow tester.

Preparation of Aqueous Medium

An aqueous medium is prepared by uniformly mixing and agitating 300 parts of ion-exchange water, 300 parts of the resin particle dispersion W, and 0.2 parts of sodium dodecylbenzenesulfonate.

Preparation of Resin Solution

A resin solution 101 is prepared by mixing the first and second resins in amounts described in Table 10 and 80 parts of ethyl acetate in a reaction vessel.

TABLE 10

| | | First binder resin | | Second binder resin | |
|---|---|---|---|---|---|
| | Toner No. | No. | Parts | No. | Parts |
| Example 101 | 101 | 101 | 70 | A | 30 |
| Example 102 | 102 | 102 | 60 | B | 40 |
| Example 103 | 103 | 103 | 90 | C | 10 |
| Example 104 | 104 | 104 | 70 | D | 30 |
| Example 105 | 105 | 105 | 80 | E | 20 |
| Example 106 | 106 | 106 | 80 | C | 20 |
| Example 107 | 107 | 107 | 70 | B | 30 |
| Example 108 | 108 | 108 | 70 | A | 30 |
| Example 109 | 109 | 109 | 70 | A | 30 |
| Example 110 | 110 | 110 | 70 | A | 30 |
| Example 111 | 111 | 101 | 70 | F | 30 |
| Example 112 | 112 | 103 | 70 | G | 30 |
| Example 113 | 113 | 101 | 70 | H Precursor | 30 |

TABLE 10-continued

| | Toner No. | First binder resin No. | First binder resin Parts | Second binder resin No. | Second binder resin Parts |
|---|---|---|---|---|---|
| Example 114 | 114 | 103 | 70 | I Precursor | 30 |
| Example 115 | 115 | 101 | 70 | J Precursor | 30 |
| Example 116 | 116 | 103 | 95 | A | 5 |
| Example 117 | 117 | 101 | 50 | A | 50 |
| Example 118 | 118 | 103 | 70 | K | 30 |
| Comparative Example 101 | 119 | 111 | 70 | A | 30 |
| Comparative Example 102 | 120 | 112 | 70 | F | 30 |
| Comparative Example 103 | 121 | 113 | 70 | A | 30 |
| Comparative Example 104 | 122 | 114 | 70 | B | 30 |
| Comparative Example 105 | 123 | 115 | 70 | A | 30 |
| Comparative Example 106 | 124 | 116 | 70 | A | 30 |
| Comparative Example 107 | 125 | 101 | 70 | L | 30 |
| Comparative Example 108 | 126 | 101 | 70 | M | 30 |
| Comparative Example 109 | 127 | 101 | 100 | — | 0 |

Preparation of Oily Phase

A carnauba wax (having a molecular weight of 1,800, an acid value of 2.7 mgKOH/g, and a penetration of 1.7 mm (at 40° C.)) in an amount of 5 parts and the master batch in an amount of 5 parts are dispersed in 400 parts of the resin solution 101 by a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation is repeated 3 times (3 passes). Thus, an oily phase 1 is prepared.

Preparation of Toner

In a vessel, 150 parts of the aqueous medium are mixed with 100 parts of the oily phase 1 for 10 minutes by a TK HOMOMIXER (from PRIMIX Corporation) at a revolution of 12,000 rpm. Thus, an emulsion slurry is prepared. A flask equipped with a stirrer and a thermometer is charged with 100 parts of the emulsion slurry. The emulsion slurry is agitated for 10 hours at 30° C. at a peripheral speed of 20 m/min so that the solvents are removed therefrom. Thus, a dispersion slurry is prepared.

Next, 100 parts of the dispersion slurry is filtered under reduced pressures to obtain a wet cake (i). The wet cake (i) is then mixed with 100 parts of ion-exchange water by a TK HOMOMIXER for 10 minutes at a revolution of 12,000 rpm, followed by filtration, thus obtaining a wet cake (ii). The wet cake (ii) is mixed with 300 parts of ion-exchange water by a TK HOMOMIXER for 10 minutes at a revolution of 12,000 rpm, followed by filtration. This operation is repeated twice, thus obtaining a wet cake (iii). The wet cake (iii) is mixed with 20 parts of a 10% aqueous solution of sodium hydroxide by a TK HOMOMIXER for 30 minutes at a revolution of 12,000 rpm, followed by filtration under reduced pressures, thus obtaining a wet cake (iv).

The wet cake (iv) is mixed with 300 parts of ion-exchange water by a TK HOMOMIXER for 10 minutes at a revolution of 12,000 rpm, followed by filtration. This operation is repeated twice, thus obtaining a wet cake (v). The wet cake (v) is mixed with 20 parts of a 10% hydrochloric acid by a TK HOMOMIXER for 10 minutes at a revolution of 12,000 rpm. Thereafter, a 5% methanol solution of a fluorine-containing quaternary ammonium salt (FTERGENT F-310 from Neos Company Limited) is added so that the resulting mixture includes 0.1 parts of the fluorine-containing quaternary ammonium salt based on 100 parts of the solid constituents. The mixture is further agitated for 10 minutes, followed by filtration, thus obtaining a wet cake (vi). The wet cake (vi) is mixed with 300 parts of ion-exchange water by a TK HOMOMIXER for 10 minutes at a revolution of 12,000 rpm, followed by filtration. This operation is repeated twice, thus obtaining a wet cake (vii). The wet cake (vii) is dried by a circulating drier for 36 hours at 40° C. and filtered with a mesh having openings of 75 μm. Thus, a mother toner 101 is prepared.

The mother toner 101 in an amount of 100 parts is mixed with 1.0 part of a hydrophobized silica (H2000 from Clariant Japan K.K.) by a HENSCHEL MIXER (from Mitsui Mining Co., Ltd.) at a peripheral speed of 30 msec for 30 seconds, followed by a pause for 1 minute. This mixing operation is repeated for 5 times (5 cycles). The mixture is sieved with a mesh having openings of 35 μm. Thus, a toner 101 was prepared.

Preparation of Carrier

A resin layer coating liquid is prepared by dispersing 100 parts of a silicone resin (organo straight silicone), 5 parts of γ-(2-aminoethyl)aminopropyl trimethoxysilane, and 10 parts of a carbon black in 100 parts of toluene by a homomixer for 20 minutes.

The resin layer coating liquid is applied to the surfaces of 1,000 parts of magnetite particles having a volume average particle diameter of 50 μm by a fluidized bed coating device. Thus, a carrier is prepared.

Preparation of Developer

The toner 101 in an amount of 5 parts and the carrier in an amount of 95 parts are mixed. Thus, a developer 101 is prepared.

Example 102

The procedure for preparing the toner 101 and the developer 101 is repeated except that the first and second resins are changed as described in Table 10. Thus, a toner 102 and a developer 102 are prepared.

Example 103

The procedure for preparing the toner 101 and the developer 101 is repeated except that the first and second resins are changed as described in Table 10. Thus, a toner 103 and a developer 103 are prepared.

Example 104

The procedure for preparing the toner 101 and the developer 101 is repeated except that the first and second resins are changed as described in Table 10. Thus, a toner 104 and a developer 104 are prepared.

Example 105

The procedure for preparing the toner 101 and the developer 101 is repeated except that the first and second resins are changed as described in Table 10. Thus, a toner 105 and a developer 105 are prepared.

Example 106

The procedure for preparing the toner 101 and the developer 101 is repeated except that the first and second resins are changed as described in Table 10. Thus, a toner 106 and a developer 106 are prepared.

Example 107

The procedure for preparing the toner 101 and the developer 101 is repeated except that the first and second resins are changed as described in Table 10. Thus, a toner 107 and a developer 107 are prepared.

Example 108

The procedure for preparing the toner 101 and the developer 101 is repeated except that the first and second resins are changed as described in Table 10. Thus, a toner 108 and a developer 108 are prepared.

Example 109

The procedure for preparing the toner 101 and the developer 101 is repeated except that the first and second resins are changed as described in Table 10. Thus, a toner 109 and a developer 109 are prepared.

Example 110

The procedure for preparing the toner 101 and the developer 101 is repeated except that the first and second resins are changed as described in Table 10. Thus, a toner 110 and a developer 110 are prepared.

Example 111

The procedure for preparing the toner 101 and the developer 101 is repeated except that the first and second resins are changed as described in Table 10. Thus, a toner 111 and a developer 111 are prepared.

Example 112

The procedure for preparing the toner 101 and the developer 101 is repeated except that the first and second resins are changed as described in Table 10. Thus, a toner 112 and a developer 112 are prepared.

Example 113

The procedure for preparing the toner 101 and the developer 101 is repeated except that the first and second resins are changed as described in Table 10 and the oily phase is prepared by further adding the ketimine compound in an amount described in Table 11. Thus, a toner 113 and a developer 113 are prepared.

TABLE 11

| | Oily phase No. | First binder resin No. | Ketimine compound (parts) |
|---|---|---|---|
| Example 113 | 113 | H Precursor | 2.66 |
| Example 114 | 114 | I Precursor | 2.82 |
| Example 115 | 115 | J Precursor | 2.72 |

Example 114

The procedure for preparing the toner 101 and the developer 101 is repeated except that the first and second resins are changed as described in Table 10 and the oily phase is prepared by further adding the ketimine compound in an amount described in Table 11. Thus, a toner 114 and a developer 114 are prepared.

Example 115

The procedure for preparing the toner 101 and the developer 101 is repeated except that the first and second resins are changed as described in Table 10 and the oily phase is prepared by further adding the ketimine compound in an amount described in Table 11. Thus, a toner 115 and a developer 115 are prepared.

Example 116

The procedure for preparing the toner 101 and the developer 101 is repeated except that the first and second resins are changed as described in Table 10. Thus, a toner 116 and a developer 116 are prepared.

Example 117

The procedure for preparing the toner 101 and the developer 101 is repeated except that the first and second resins are changed as described in Table 10. Thus, a toner 117 and a developer 117 are prepared.

Example 118

The procedure for preparing the toner 101 and the developer 101 is repeated except that the first and second resins are changed as described in Table 10. Thus, a toner 118 and a developer 118 are prepared.

Comparative Example 101

The procedure for preparing the toner 101 and the developer 101 is repeated except that the first and second resins are changed as described in Table 10. Thus, a comparative toner 119 and a comparative developer 119 are prepared.

Comparative Example 102

The procedure for preparing the toner 101 and the developer 101 is repeated except that the first and second resins are changed as described in Table 10. Thus, a comparative toner 120 and a comparative developer 210 are prepared.

Comparative Example 103

The procedure for preparing the toner 101 and the developer 101 is repeated except that the first and second resins are changed as described in Table 10. Thus, a comparative toner 121 and a comparative developer 121 are prepared.

Comparative Example 104

The procedure for preparing the toner 101 and the developer 101 is repeated except that the first and second resins are changed as described in Table 10. Thus, a comparative toner 122 and a comparative developer 122 are prepared.

Comparative Example 105

The procedure for preparing the toner 101 and the developer 101 is repeated except that the first and second resins are changed as described in Table 10. Thus, a comparative toner 123 and a comparative developer 123 are prepared.

Comparative Example 106

The procedure for preparing the toner 101 and the developer 101 is repeated except that the first and second resins are changed as described in Table 10. Thus, a comparative toner 124 and a comparative developer 124 are prepared.

Comparative Example 107

The procedure for preparing the toner 101 and the developer 101 is repeated except that the first and second resins are changed as described in Table 10. Thus, a comparative toner 125 and a comparative developer 125 are prepared.

Comparative Example 108

The procedure for preparing the toner 101 and the developer 101 is repeated except that the first and second resins are changed as described in Table 10. Thus, a comparative toner 126 and a comparative developer 126 are prepared.

Comparative Example 109

The procedure for preparing the toner 101 and the developer 101 is repeated except that the first and second resins are changed as described in Table 10. Thus, a comparative toner 127 and a comparative developer 127 are prepared.

The above-prepared toners or developers are subjected to the following evaluations of fixability, heat-resistant storage stability, temporal charge stability, and the number of white spots. The evaluation results are shown in Table 12.

Evaluation of Fixability

An electrophotographic copier (MF-200 from Ricoh Co., Ltd.) employing a TEFLON® fixing roller is modified so that the temperature of the fixing roller is variable. Each developer is mounted on the copier, and a solid image having 0.85±0.1 mg/cm$^2$ of toner is formed on sheets of a normal paper TYPE 6200 (from Ricoh Co., Ltd.) and a thick paper <135> (from NBS Ricoh) while varying the temperature of the fixing roller to determine the maximum and minimum fixable temperatures. The maximum fixable temperature is a temperature above which hot offset occurs on the normal paper. The minimum fixable temperature is a temperature below which the residual rate of image density after rubbing the solid image falls below 70% on the thick paper. The maximum and minimum fixable temperatures are graded as follows. Grades A to C can be brought into practical use.

Maximum Fixable Temperature Grades

A: not less than 190° C.

B: not less than 180° C. and less than 190° C.

C: not less than 170° C. and less than 180° C.

D: less than 170° C.

Minimum Fixable Temperature Grades

A: less than 120° C.

B: not less than 120° C. and less than 130° C.

C: not less than 130° C. and less than 140° C.

D: not less than 140° C.

Evaluation of Heat-Resistant Storage Stability (Penetration)

A 50-ml glass vial is filled with each toner and left in a constant-temperature chamber at 50° C. for 24 hours, followed by cooling to 24° C. The toner is then subjected to a penetration test based on JIS K-2235-1991. The greater the penetration, the better the heat-resistant storage stability of the toner. A toner with a penetration less than 5 mm may not be brought into practical use. Grades A to C can be brought into practical use.

Penetration Grades

A: not less than 25 mm

B: not less than 15 mm and less than 25 mm

C: not less than 5 mm and less than 15 mm

D: less than 5 mm

Evaluation of Temporal Charge Stability

Each developer is set in a digital full-color printer (IMAGIO NEO C455 from Ricoh Co., Ltd.) to perform a running test in which a monochrome image chart having an image area ratio of 50% is continuously formed on 300,000 sheets of paper. Temporal charge stability is evaluated by charge variation of the carrier before and after the running test. Specifically, the initial charge Q1 is measured as follows. First, 6.000 g of the fresh carrier and 0.452 g of each toner are left for 30 minutes or more at 23° C., 50% RH (i.e., M/M environment). Thereafter, the carrier and toner are sealed in a stainless-steel container and shaken for 5 minutes by a shaker YS-LD (from YAYOI Co., Ltd.) at an output scale of 150 so that the carrier and toner are frictionally charged by about 1,100 times of shaking. The carrier and toner are subjected to a measurement of charge by a blow off charge measuring device (TB-200 from KYOCERA Chemical Corporation). The charge Q2 of the developer exposed to the running set is measured by the same manner. The charge variation is determined from $\Delta Q=|Q1-Q2|$ and graded as follows. Grades A to C can be brought into practical use.

Temporal Charge Stability Grades

A: ΔQ is less than 10 μC/g

B: ΔQ is not less than 10 μC/g and less than 15 μC/g

C: ΔQ is not less than 15 μC/g and less than 20 μC/g

D: ΔQ is not less than 20 μC/g

Evaluation of White Spots

Each developer is mounted on a full-color copier (IMAGIO NEO C455 from Ricoh Co., Ltd.) and A3-size solid image is formed on 100 sheets of paper. The 100th sheet is observed to count the number of white spots generated in the solid image. The number of white spots is graded as follows. Grades A and B can be brought into practical use.

Grades

A: less than 3

B: not less than 3 and less than 5

C: not less than 5

TABLE 12

| | Toner No. | Fixability | | Heat-resistant storage stability | Temporal charge stability | Number of white spots |
|---|---|---|---|---|---|---|
| | | Minimum fixable temperature | Maximum fixable temperature | | | |
| Example 101 | 101 | A | A | A | A | A |
| Example 102 | 102 | A | A | A | A | A |
| Example 103 | 103 | A | A | A | A | A |
| Example 104 | 104 | A | A | A | A | A |
| Example 105 | 105 | B | B | B | B | B |
| Example 106 | 106 | B | A | A | A | A |
| Example 107 | 107 | B | A | A | A | A |
| Example 108 | 108 | A | A | A | A | A |
| Example 109 | 109 | B | A | B | B | B |
| Example 110 | 110 | C | A | C | C | B |
| Example 111 | 111 | C | A | A | B | B |
| Example 112 | 112 | A | A | B | B | B |
| Example 113 | 113 | A | A | A | A | A |
| Example 114 | 114 | B | A | A | A | A |
| Example 115 | 115 | B | A | A | A | A |
| Example 116 | 116 | A | A | B | B | B |
| Example 117 | 117 | B | A | A | A | A |
| Example 118 | 118 | C | B | B | B | B |
| Comparative Example 101 | 119 | A | B | C | D | C |
| Comparative Example 102 | 120 | A | C | C | D | C |
| Comparative Example 103 | 121 | D | A | A | A | A |
| Comparative Example 104 | 122 | D | B | A | A | A |
| Comparative Example 105 | 123 | D | A | A | A | A |
| Comparative Example 106 | 124 | D | C | D | D | C |
| Comparative Example 107 | 125 | A | A | A | D | C |
| Comparative Example 108 | 126 | D | A | A | A | A |
| Comparative Example 109 | 127 | A | A | A | D | C |

In all Examples 101-118, the first binder resin has first and second glass transition points at a temperature Tg1 of −20 to 20° C. and a temperature Tg2 of 35 to 65° C., respectively, measured by a differential scanning calorimeter at a heating rate of 5° C./min; a ratio h1/h2 of a baseline displacement h1 observed in the first glass transition point to a baseline displacement h2 observed in the second glass transition point is less than 1.0; the first binder resin has a structure in which a first phase is dispersed in a second phase, the first and second phases consisting of portions having larger and smaller phase difference values, respectively, than an intermediate value between maximum and minimum phase difference values in a binarized phase image obtained by an atomic force microscope with a tapping mode method, and the average of maximum Feret diameters among domains of the first phase is less than 100 nm; and the second binder resin has a number average molecular weight of 8,000 to 25,000 and a glass transition temperature Tg3 of −5 to 15° C. The toners have a good combination of low-temperature fixability, heat-resistant storage stability, and charge stability, and few white spots are observed.

In Comparative Example 1, h1/h2 is not less than 1 and the average domain size of the low-Tg unit is not less than 100 nm. The evaluation results for heat-resistant storage stability, charge stability, and white spots are poor.

In Comparative Example 2, Tg1 is too low. The evaluation results for heat-resistant storage stability, charge stability, and white spots are poor.

In Comparative Example 3, Tg1 is too high. The evaluation result for minimum fixable temperature is poor.

In Comparative Examples 4, 5, and 6, it is apparent from the results of DSC and AFM that the low-Tg unit is not finely dispersed in the first binder resin. The evaluation result for minimum fixable temperature is poor.

In comparative Example 7, Mn of the second binder resin is too small to prevent the low-Tg unit of the first binder resin from exuding from the toner. The evaluation results for charge stability and white spots are poor.

In comparative Example 8, Mn of the second binder resin is so large that the second binder resin prevents the first binder resin from adhering to paper. The evaluation result for minimum fixable temperature is poor.

In Comparative Example 9, the second binder resin is not used. The evaluation results for charge stability and white spots are poor.

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising:

a colorant; and a first binder resin, wherein the first binder resin is a block copolymer of a polyester backbone A having a repeating unit obtained from a dehydration condensation of a hydroxycarboxylic acid with another backbone B having no repeating unit obtained from a dehydration condensation of a hydroxycarboxylic acid;

wherein the first binder resin has first and second glass transition points at a temperature Tg1 of −20 to 20° C. and a temperature Tg2 of 35 to 65° C., respectively, measured by a differential scanning calorimeter at a heating rate of 5° C./min, wherein a ratio h1/h2 of a baseline displacement h1 observed in the first glass transition point to a baseline displacement h2 observed in the second glass transition point is less than 1.0, and wherein the first binder resin has a structure in which a first phase is dispersed in a second phase, the first and second phases consisting of portions having larger and smaller phase difference values, respectively, than an intermediate value between maximum and minimum phase difference values in a binarized phase image obtained by an atomic force microscope with a tapping mode method.

2. The toner according to claim 1, wherein an average of maximum Feret diameters among domains of the first phase is less than 100 nm.

3. The toner according to claim 1, wherein the backbone B is a polyester backbone having a branched structure.

4. The toner according to claim 3, wherein the polyester backbone having a branched structure is obtained from acid constituents including 1.5% by mol or more of a polycarboxylic acid having three or more valences.

5. The toner according to claim 1, wherein the polyester backbone A is obtained from a ring-opening polymerization of L-lactide with D-lactide.

6. The toner according to claim 1, wherein a weight ratio of the backbone B in the first binder resin is 25% to 50%.

7. The toner according to claim 1, wherein the backbone B has a number average molecular weight of 3,000 to 5,000.

8. The toner according to claim 1, wherein the first binder resin has a number average molecular weight of 20,000 or less.

9. The toner according to claim 1, further comprising:

a second binder resin having a number average molecular weight of 8,000 to 25,000 and a glass transition temperature Tg3 of −5 to 15° C.

10. The toner according to claim 9, wherein the second binder resin has a number average molecular weight of 10,000 to 20,000.

11. A developer, comprising:

the toner according to claim 1; and a carrier.

12. An image forming apparatus, comprising:

an electrostatic latent image bearing member;

a charger adapted to charge a surface of the electrostatic latent image bearing member;

an irradiator adapted to irradiate the charged surface of the electrostatic latent image bearing member to form an electrostatic latent image thereon;

a developing device containing the developer according to claim 11, the developing device being adapted to develop the electrostatic latent image into a toner image with the developer;

a transfer device adapted to transfer the toner image from the electrostatic latent image bearing member onto a recording medium; and a fixing device adapted to fix the toner image on the recording medium.

13. The toner according to claim 1, wherein the backbone B having no repeating unit obtained from a dehydration condensation of a hydroxycarboxylic acid is obtained from a compound having at least two hydroxyl groups.

* * * * *